US009945020B2

(12) United States Patent
Sohn et al.

(10) Patent No.: US 9,945,020 B2
(45) Date of Patent: Apr. 17, 2018

(54) ZINC-PLATED STEEL SHEET FOR HOT PRESSING HAVING OUTSTANDING SURFACE CHARACTERISTICS, HOT-PRESSED MOULDED PARTS OBTAINED USING THE SAME, AND A PRODUCTION METHOD FOR THE SAME

(71) Applicant: POSCO, Pohang-si (KR)

(72) Inventors: Il-Ryoung Sohn, Gwangyang (KR); Jong-Sang Kim, Gwangyang (KR); Joong-Chul Park, Gwangyang (KR); Yeol-Rae Cho, Gwangyang (KR); Jin-Keun Oh, Gwangyang (KR); Han-Gu Cho, Gwangyang (KR); Bong-Hoon Chung, Gwangyang (KR); Jong-Seog Lee, Gwangyang (KR)

(73) Assignee: POSCO, Pohang-si (KR)

( * ) Notice: Subject to any disclaimer, the term of this patent is extended or adjusted under 35 U.S.C. 154(b) by 245 days.

(21) Appl. No.: 14/703,065

(22) Filed: May 4, 2015

(65) Prior Publication Data

US 2015/0307977 A1 Oct. 29, 2015

Related U.S. Application Data

(62) Division of application No. 13/518,904, filed as application No. PCT/KR2010/009392 on Dec. 28, 2010, now Pat. No. 9,068,255.

(30) Foreign Application Priority Data

Dec. 29, 2009 (KR) ..... 10-2009-0132777
Dec. 28, 2010 (KR) ..... 10-2010-0136211
(Continued)

(51) Int. Cl.
*C23C 28/00* (2006.01)
*C23C 14/08* (2006.01)
(Continued)

(52) U.S. Cl.
CPC ..... *C23C 2/28* (2013.01); *C22C 38/001* (2013.01); *C22C 38/04* (2013.01); *C23C 2/02* (2013.01);
(Continued)

(58) Field of Classification Search
CPC ..... C22C 38/001; C22C 38/04; Y10T 428/12792; Y10T 428/12799; C23C 2/06;
(Continued)

(56) References Cited

U.S. PATENT DOCUMENTS 5,203,985 A 4/1993 Nishimura et al.
5,447,802 A 9/1995 Tobiyama et al.
(Continued)

FOREIGN PATENT DOCUMENTS

CN 1531604 A 9/2004
CN 1771344 A 5/2006
(Continued)

*Primary Examiner* — Lois L Zheng
(74) *Attorney, Agent, or Firm* — The Webb Law Firm

(57) ABSTRACT

Provided is a zinc-plated steel sheet for hot pressing having outstanding surface characteristics, comprising: a steel foundation plate comprising a metal surface diffusion layer of which the Gibbs free energy reduction per mole of oxygen during oxidation is less than that of Cr, an aluminum-rich layer containing at least 30 wt. % of aluminum formed on the surface diffusion layer, and a zinc plating layer formed on the aluminum-rich layer. In this way, a metal having a low affinity for oxygen is coated to an effective thickness prior to annealing and thus the creation of annealing oxides at the surface of the steel sheet is suppressed and a uniform zinc plating layer is formed, and alloying of the zinc plating layer is promoted during press-processing heat treatment. Cracking in the steel foundation plate during hot press molding is prevented.

12 Claims, 6 Drawing Sheets

(30) Foreign Application Priority Data

Dec. 28, 2010 (KR) ..... 10-2010-0136212
Dec. 28, 2010 (KR) ..... 10-2010-0136213
Dec. 28, 2010 (KR) ..... 10-2010-0136214

(51) Int. Cl.

| | |
|---|---|
| ***C23C 2/06*** | (2006.01) |
| ***C23C 2/28*** | (2006.01) |
| ***C23C 2/02*** | (2006.01) |
| ***C22C 38/00*** | (2006.01) |
| ***C22C 38/04*** | (2006.01) |
| *C23C 8/10* | (2006.01) |

(52) U.S. Cl.
CPC ..... *C23C 2/06* (2013.01); *Y10T 428/12799* (2015.01); *Y10T 428/12917* (2015.01); *Y10T 428/12924* (2015.01); *Y10T 428/12931* (2015.01); *Y10T 428/12937* (2015.01); *Y10T 428/12951* (2015.01); *Y10T 428/12958* (2015.01)

(58) Field of Classification Search
CPC .... C23C 2/12; C23C 2/26; C23C 2/28; C23C 8/10–8/18; C23C 14/08; C23C 14/086; C23C 28/023; C23C 28/025
USPC ..... 148/277, 284, 285, 287
See application file for complete search history.

(56) References Cited

U.S. PATENT DOCUMENTS

| | | | |
|---|---|---|---|
| 6,296,805 | B1 | 10/2001 | Laurent et al. |
| 6,699,590 | B2 | 3/2004 | Takeda et al. |
| 7,399,535 | B2 | 7/2008 | Yoshikawa et al. |
| 7,687,152 | B2 | 3/2010 | Ikematsu et al. |
| 7,695,826 | B2 | 4/2010 | Tanaka et al. |
| 8,697,252 | B2 | 4/2014 | Irie et al. |
| 2005/0252262 | A1 | 11/2005 | Imai et al. |
| 2006/0121305 | A1 | 6/2006 | Yoshikawa et al. |
| 2008/0075970 | A1 | 3/2008 | Suzuki et al. |
| 2008/0286603 | A1 | 11/2008 | Oh et al. |
| 2010/0193081 | A1 | 8/2010 | Mataigne et al. |
| 2012/0321903 | A1 | 12/2012 | Nakamaru et al. |

FOREIGN PATENT DOCUMENTS

| | | | | | |
|---|---|---|---|---|---|
| CN | 1771348 | A | | 5/2006 | |
| CN | 101316942 | A | | 12/2008 | |
| CN | 101583734 | A | | 11/2009 | |
| EP | 0900857 | A1 | | 3/1999 | |
| JP | 57-076176 | | | 5/1982 | |
| JP | 58-117866 | | | 7/1983 | |
| JP | 02-236263 | | | 9/1990 | |
| JP | 6088187 | A | | 3/1994 | |
| JP | 06-128758 | | | 5/1994 | |
| JP | 6060376 | A | | 8/1994 | |
| JP | 2000-160358 | | | 6/2000 | |
| JP | 2002322551 | A | | 11/2002 | |
| JP | 2003073774 | A | | 3/2003 | |
| JP | 2004270029 | A | | 9/2004 | |
| JP | 2004323897 | A | | 11/2004 | |
| JP | 2005074464 | A | | 3/2005 | |
| JP | 2005113233 | A | | 4/2005 | |
| JP | 200622395 | A | | 1/2006 | |
| JP | 2006097094 | A | | 4/2006 | |
| JP | 2006265583 | A | | 10/2006 | |
| JP | 2006-299341 | | | 11/2006 | |
| JP | 2007-056307 | | * | 3/2007 | ..... C23C 2/28 |
| JP | 2007056307 | A | | 3/2007 | |
| JP | 2007070732 | A | | 3/2007 | |
| JP | 2010532820 | A | | 10/2010 | |
| JP | 2011246801 | A | | 12/2011 | |

* cited by examiner

ZINC-PLATED STEEL SHEET FOR HOT PRESSING HAVING OUTSTANDING SURFACE CHARACTERISTICS, HOT-PRESSED MOULDED PARTS OBTAINED USING THE SAME, AND A PRODUCTION METHOD FOR THE SAME

CROSS REFERENCE TO RELATED APPLICATIONS

This application is a divisional of U.S. patent application Ser. No. 13/518,904, filed Dec. 28, 2010, which is the national phase of International Patent Application No. PCT/KR2010/0093 filed Dec. 28, 2010, which claims the benefit of South Korean Patent Application Nos. 10-2009-013277, filed Dec. 29, 2009, 10-2010-0136214, filed Dec. 28, 2010, 10-2010-0136213, filed Dec. 28, 2010, 10-2010-0136212, filed Dec. 28, 2010, and 10-2010-0136211, filed Dec. 28, 2010, the disclosures of which are all hereby incorporated by reference for all purposes in their entireties.

BACKGROUND OF THE INVENTION

1. Technical Field

The present invention relates to a zinc-plated steel sheet for hot press forming and more particularly, to a zinc-plated steel sheet for hot pressing having excellent surface characteristics able to secure a stable plating layer by preventing deterioration of the plating layer during hot press forming, a hot-pressed part using the same, and a method of manufacturing thereof.

2. Background Art

Recently, demand for high-strength steel sheets for the purpose of improving vehicle fuel economy to meet with environmental protection regulations has rapidly increased. In accordance with the strengthening of automotive steel sheets, wear and fracturing may occur during press forming, and the formation of complex-shaped products may be difficult. Therefore, in order to resolve such limitations, the production of products by hot pressing, in which a steel sheet is heated to be molded in a hot state, has greatly increased.

A steel sheet for hot pressing is generally subjected to hot press forming in a temperature range of 800° C. to 900° C., and a surface of the steel sheet may be oxidized, thereby generating scaling. Therefore, a separate process for removing scaling after product formation, such as shot blasting, is required, such that product corrosion resistance may also be inferior to that of a plated material.

Therefore, in order to address such limitations, products as that of U.S. Pat. No. 6,296,805, in which aluminum (Al)-based plating is performed on a steel sheet surface to maintain a plating layer, while formation of an oxidation reaction of the steel sheet surface in a heating furnace is prevented and corrosion resistance is increased through the formation of a passive Al film, have been developed and commercialized.

However, with respect to the Al-plated material, heat resistance at high temperatures is excellent, while corrosion resistance may be inferior to that of a zinc (Zn)-plated steel sheet formed through a sacrificial anode method and manufacturing costs may also increase.

Since Zn high-temperature heat resistance is significantly inferior to that of Al, a plating layer of a Zn-plated steel sheet manufactured via a typical manufacturing method may be non-uniformly formed due to alloying of a Zn layer and high-temperature oxidation in a high temperature range of 800° C. to 900° C., and a ratio of Zn in the plating layer may be decreased to less than 30%. Therefore, its functionality as a plating material may be reduced in terms of corrosion resistance.

SUMMARY OF THE INVENTION

An aspect of the present invention provides a zinc-plated steel sheet having excellent surface characteristics able to prevent deterioration of a zinc plating layer during hot press forming of a plated material using zinc plating and minimize generation of oxides on a surface of the plating layer after hot press forming, a hot-pressed part using the zinc-plated steel sheet, and a method of manufacturing the hot pressed part.

According to an aspect of the present invention, there is provided a zinc-plated steel sheet for hot pressing having excellent surface characteristics including: a base steel sheet including a metal surface diffusion layer, in which a reduced amount of Gibbs free energy for one mole of oxygen during an oxidation reaction is lower than that of chromium (Cr), to a depth of about 1 μm from a surface; an aluminum (Al)-rich layer containing about 30 wt % or more of Al formed on the surface diffusion layer of the metal in which a reduced amount of Gibbs free energy for one mole of oxygen during an oxidation reaction is smaller than that of Cr; and a zinc plating layer formed on the Al-rich layer, wherein an annealing oxide having an average thickness of about 150 nm or less is non-uniformly distributed between the surface diffusion layer and the Al-rich layer, and a content of the metal, in which a reduced amount of Gibbs free energy for one mole of oxygen during an oxidation reaction is smaller than that of Cr, to a depth of about 1 μm from the surface of the base steel sheet is about 0.1 wt % or more.

The zinc plating layer may include about 15.0 wt % or less of iron (Fe); about 0.01 wt % to about 2.0 wt % of the metal in which a reduced amount of Gibbs free energy for one mole of oxygen during an oxidation reaction is smaller than that of Cr; and zinc (Zn) as well as unavoidable impurities as a remainder.

The metal, in which a reduced amount of Gibbs free energy for one mole of oxygen during an oxidation reaction is smaller than that of Cr, may be one or more selected from the group consisting of nickel (Ni), iron (Fe), cobalt (Co), copper (Cu), tin (Sn), and antimony (Sb).

A thickness of the Al-rich layer may be in a range of about 0.1 μm to about 1 μm and an area, portions of which have a content of metal in which a reduced amount of Gibbs free energy for one mole of oxygen during an oxidation reaction is smaller than that of Cr, of which about 5 wt % or more are overlapped among the Al-rich layer and the surface diffusion layer during electron probe microanalyzer (EPMA) analysis, may be about 10% or less with respect to the surface diffusion layer and the Al-rich layer.

The base steel sheet may include about 0.1 wt % to about 0.4 wt % of carbon (C), about 2.0 wt % or less (excluding 0 wt %) of silicon (Si), about 0.1 wt % to about 4.0 wt % of manganese (Mn), and Fe as well as unavoidable impurities as a remainder.

The base steel sheet may further include (in wt %) one or more selected from the group consisting of about 0.001% to about 0.02% of nitrogen (N), about 0.0001% to about 0.01% of boron (B), about 0.001% to about 0.1% of titanium (Ti), about 0.001% to about 0.1% of niobium (Nb), about 0.001% to about 0.1% of vanadium (V), about 0.001% to about 1.0% of Cr, about 0.001% to about 1.0% of molybdenum (Mo), about 0.001% to about 0.1% of Sb, and about 0.001% to about 0.3% of tungsten (W).

According to another aspect of the present invention, there is provided a hot-pressed part including: a base steel sheet; a zinc plating layer including a Fe—Zn phase having a metal, in which a reduced amount of Gibbs free energy for one mole of oxygen during an oxidation reaction is smaller than that of Cr, dissolved in an amount of about 0.008 wt % or more formed on the base steel sheet; and an oxide layer having an average thickness range of about 0.01 μm to about 5 μm formed on the zinc plating layer.

The oxide layer may include a continuous coating layer having an average thickness range of about 10 nm to about 300 nm and formed of one or more oxides selected from the group consisting of $SiO_2$ and $Al_2O_3$.

The oxide layer may include ZnO and may include about 0.01 wt % to about 50 wt % of one or more oxides selected from the group consisting of MnO, $SiO_2$, and $Al_2O_3$.

An oxide including ZnO and MnO may be formed on the continuous coating layer and a content of MnO may be smaller than that of ZnO.

The oxide layer may include about 10 wt % or less of FeO.

A zinc diffusion phase may non-uniformly exist at an upper portion of the base steel sheet.

An average thickness of the zinc diffusion phase may be about 5 μm or less.

A Zn content of the zinc plating layer may be about 30 wt % or more.

A thickness of the zinc plating layer may be about 1.5 times larger than that before hot press forming.

A ratio of an alloy phase having a Fe content of about 60 wt % or more in the zinc plating layer may be about 70 wt % or more with respect to the total zinc plating layer.

The metal, in which a reduced amount of Gibbs free energy for one mole of oxygen during an oxidation reaction is be smaller than that of Cr, may be one or more selected from the group consisting of Ni, Fe, Co, Cu, Sn, and Sb.

The base steel sheet may include about 0.1 wt % to about 0.4 wt % of C, about 2.0 wt % or less (excluding 0 wt %) of Si, about 0.1 wt % to about 4.0 wt % of Mn, and Fe as well as unavoidable impurities as a remainder.

The base steel sheet may further include one or more selected from the group consisting of about 0.001% to about 0.02% of N, about (in wt %) 0.0001% to about 0.01% of B, about 0.001% to about 0.1% of Ti, about 0.001% to about 0.1% of Nb, about 0.001% to about 0.1% of V, about 0.001% to about 1.0% of Cr, about 0.001% to about 1.0% of Mo, about 0.001% to about 0.1% of Sb, and about 0.001% to about 0.3% of W.

According to another aspect of the present invention, there is provided a method of manufacturing a hot-pressed part including: coating a metal, in which a reduced amount of Gibbs free energy for one mole of oxygen during an oxidation reaction is smaller than that of Cr, on a steel sheet; annealing the coated steel sheet within a temperature range of about 700° C. to about 900° C.; zinc plating the annealed steel sheet by dipping in a molten zinc plating bath having a temperature range of about 430° C. to about 500° C. and including about 0.05 wt % to about 0.5 wt % of Al and Zn as well as unavoidable impurities as a remainder; heating the zinc-plated steel sheet to a temperature within a temperature range of about 750° C. to about 950° C. at a heating rate ranging from about 2° C./sec to about 10° C./sec in an oxidizing atmosphere and maintaining a temperature for about 10 minutes or less; and press forming the heated and temperature-maintained steel sheet within a temperature range of about 600° C. to about 900° C.

The coating of the metal, in which a reduced amount of Gibbs free energy for one mole of oxygen during an oxidation reaction is smaller than that of Cr, may be performed by coating one or more selected from the group consisting of Ni, Fe, Co, Cu, Sn, and Sb in an average thickness range of about 1 nm to about 1000 nm.

The method may further include performing an alloying heat treatment at a temperature of about 600° C. or less after the zinc plating.

According to an aspect of the present invention, a generation of annealing oxides on a steel sheet surface is prevented by coating the steel sheet surface with a metal having a low oxygen affinity in an effective thickness before annealing to form a uniform zinc plating layer, and alloying of the zinc plating layer is promoted during a press forming heat treatment to increase a melting temperature of the zinc plating layer within a short time. Therefore, deterioration of the plating layer may be prevented and generation of internal oxides formed after hot press forming may be minimized.

Also, according to another aspect of the present invention, an oxide layer able to prevent deterioration of the zinc plating layer is formed on a surface of the plating layer during hot press heating and a ternary phase of zinc (Zn), iron (Fe), and a metal, in which a reduced amount of Gibbs free energy for one mole of oxygen during an oxidation reaction is lower than that of chromium (Cr), is formed in the plating layer to stably maintain the zinc plating layer, good surface conditions are secured to obtain excellent phosphatability, coatability and coating layer adhesion during electrodeposition coating may be secured without a separate phosphate treatment, while processability may be improved by preventing crack generation in a base steel sheet during hot press forming.

BRIEF DESCRIPTION OF THE DRAWINGS

The above and other aspects, features and other advantages of the present invention will be more clearly understood from the following detailed description taken in conjunction with the accompanying drawings, in which.

Figure 1:
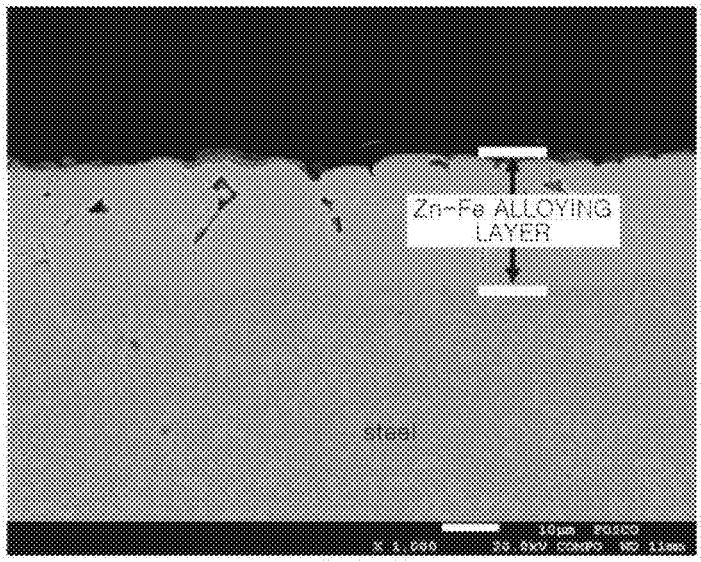
FIG. 1 is a photograph showing a cross section of a hot-dip Zn plated steel sheet after hot press forming according to an Inventive Example.

Hereinafter, the present invention will be described in detail.

[Zinc (Zn)-Plated Steel Sheet]

Hereinafter, a Zn-plated steel sheet of the present invention will be described in detail.

In one aspect of the present invention, provided is a zinc-plated steel sheet for hot pressing having excellent surface characteristics including: a base steel sheet including a metal surface diffusion layer, in which a reduced amount of Gibbs free energy for one mole of oxygen during an oxidation reaction is lower than that of chromium (Cr), to a depth of 1 μm from a surface; an aluminum (Al)-rich layer containing 30 wt % or more of Al formed on the surface diffusion layer of the metal in which a reduced amount of Gibbs free energy for one mole of oxygen during an oxidation reaction is smaller than that of Cr; and a zinc plating layer formed on the Al-rich layer, wherein an annealing oxide having an average thickness of 150 nm or less is non-uniformly distributed between the surface diffusion layer and the Al-rich layer and a content of the metal, in which a reduced amount of Gibbs free energy for one mole of oxygen during an oxidation reaction is smaller than that of Cr, to a depth of 1 μm from the surface of the base steel sheet is 0.1 wt % or more.

Both the hot-rolled steel sheet and cold-rolled steel sheet may be used as the base steel sheet and the annealing oxide acts as a diffusion barrier preventing alloying of the hot-dip Zn plating layer and iron (Fe) and manganese (Mn), components of the steel sheet. In the present invention, a thickness of the annealing oxide is controlled to be 150 nm or less and thus, heat resistance and plating adhesion after press forming may be improved by promoting the alloying of the hot-dip Zn plating layer. The annealing oxide is non-uniformly distributed on the surface diffusion layer and some of the annealing oxides may be included in the Al-rich layer.

The thickness of the annealing oxide may be 150 nm or less. As described in the following manufacturing process, the annealing oxide is formed in the process of performing an annealing treatment after metal coating. When the thickness of the annealing oxide is more than 150 nm, a non-plating phenomenon may occur because plating is not facilitated due to an effect of the annealing oxide and sufficient heat resistance during high-temperature heating may not be secured because the alloying of the plating layer is delayed in an initial period of hot press heating. At this time, the thickness of the annealing oxide may be changed according to contents of silicon (Si) and Mn in the base steel sheet, and platability and heat resistance may be secured when the thickness of the annealing oxide is 150 nm or less.

The thickness of the annealing oxide may be controlled to be 100 nm or less. For example, the thickness of the annealing oxide may be controlled to be 50 nm or less and thus, platability and heat resistance may be maximized.

In the hot-dip Zn plated steel sheet of the present invention, a metal surface diffusion layer, in which a reduced amount of Gibbs free energy for one mole of oxygen during an oxidation reaction is smaller than that of Cr, exists to a depth of 1 μm from a surface of the steel sheet and a content of the metal to a depth of 1 μm from the surface of the base steel sheet may be 0.1 wt % or more.

The metal is diffused into a parent material in the process of performing an annealing treatment after coating and thus, a concentration thereof at the surface is reduced. According to the result of research, when the content of the metal to a depth of 1 μm from the surface is 0.1 wt % or more, a greater amount of Al may be enriched on the surface diffusion layer by allowing Al in a plating bath to react with the metal during zinc plating. The enriched Al is diffused into a surface layer portion during a press heating process and is then selectively oxidized to form a dense and thin $Al_2O_3$ oxide coating layer which acts to prevent evaporation of Zn and oxide growth. Therefore, an enriched amount of Al may be increased throughout the surface diffusion layer as described above.

That is, a metal, in which a reduced amount of Gibbs free energy for one mole of oxygen during an oxidation reaction is smaller than that of Cr, must be included in an amount of 0.1 wt % or more to a depth of 1 μm from the steel sheet surface, in order to secure heat resistance of the zinc plating layer by preventing decomposition of the zinc plating layer at a high temperature by metal coating. When the metal is included in an amount of 1.0 wt % or more, deterioration of the zinc plating layer may be effectively prevented, and for example, better heat resistance of the zinc plating layer may be secured when the content of the metal is 3.0 wt % or more.

At this time, the zinc plating layer may include 15.0 wt % or less of Fe, 0.01 wt % to 2.0 wt % of the metal, in which a reduced amount of Gibbs free energy for one mole of oxygen during an oxidation reaction is smaller than that of Cr, and Zn as well as unavoidable impurities as a remainder. The metal, in which a reduced amount of Gibbs free energy for one mole of oxygen during an oxidation reaction is smaller than that of Cr, included in the hot-dip zinc plating layer is diffused into the plating layer during hot press heating to be included in the plating layer. In particular, the metal, in which a reduced amount of Gibbs free energy for one mole of oxygen during an oxidation reaction is smaller than that of Cr, is dissolved in Fe—Zn during hot press heating to form a ternary phase and thus, diffusion of Fe in the base steel into the plating layer during press heating is reduced. As a result, the metal plays a key role in preventing the decomposition of the zinc plating layer and forming a single plating layer. Therefore, when the metal, in which a reduced amount of Gibbs free energy for one mole of oxygen during an oxidation reaction is smaller than that of Cr, is included in an amount of less than 0.01 wt % in the zinc-plated steel sheet, appropriate heat resistance may not be secured because a ternary phase may be insignificant during press heating, and an upper limit of the content of the metal may be determined as 2.0 wt % in terms of economic factors.

A type of the zinc-plated steel sheet of the present invention is not particularly limited, and a hot-dip zinc plated steel sheet, an electrogalvanized steel sheet, a dry galvanized steel sheet by plasma, or a zinc-plated steel sheet by high-temperature liquid phase Zn spray may all be included.

Also, 15.0 wt % or less of Fe may be included in the zinc plating layer. This is for increasing a melting point of Zn by allowing Fe to sufficiently diffuse into the zinc plating layer to form a Fe—Zn alloy phase and this corresponds to a very important composition for securing heat resistance.

For example, when Fe is added to 5.0 wt % or less, microcracks, which may be generated in the plating layer, may be further reduced.

The metal, in which a reduced amount of Gibbs free energy for one mole of oxygen during an oxidation reaction is smaller than that of Cr, typically includes nickel (Ni), and in addition, Fe, cobalt (Co), copper (Cu), tin (Sn), and antimony (Sb) may be used. Ni is an element having an oxygen affinity lower than that of Fe, and when a Ni surface diffusion layer is coated on the steel sheet surface, the Ni surface diffusion layer is not oxidized during an annealing process after coating and acts to prevent oxidation of pro-oxidative elements, such as Mn and Si, on the steel sheet surface. The foregoing Fe, Co, Cu, Sn, and Sb also show similar characteristics when coated on a metal surface. At this time, Fe may be used in a state alloyed with Ni, instead of being used alone.

Also, a thickness of the Al-rich layer is in a range of 0.1 μm to 1 μm, and an area, in which portions having a content of the metal of 5 wt % or more are overlapped among the Al-rich layer and the surface diffusion layer during electron probe microanalyzer (EPMA) analysis, may be 10% or less with respect to the surface diffusion layer and the Al-rich layer. After the base steel sheet is dipped in a zinc plating bath containing Al, an Al-rich layer is formed to a thickness range of 0.1 μm to 1.0 μm and the thickness may be controlled according to a content of Al. In particular, since more Al is enriched on the surface diffusion layer through an interfacial reaction when the surface diffusion layer is formed, the surface diffusion layer may significantly affect the formation of the Al-rich layer.

Figure 7:
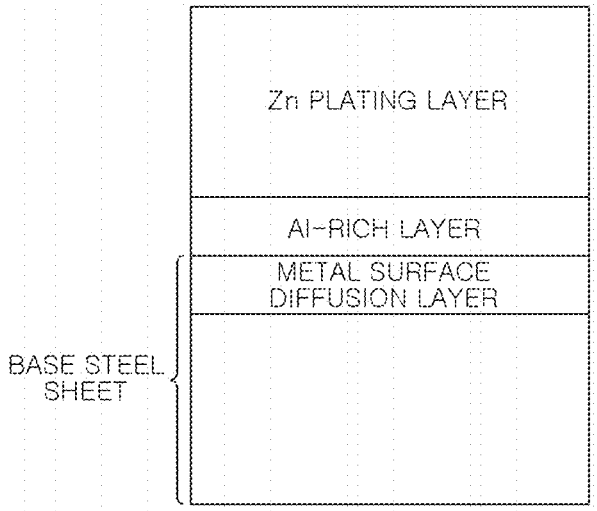
FIG. 7 is a schematic view illustrating a cross section of an example of a pressed part according to another Inventive Example.
Figure 8A:
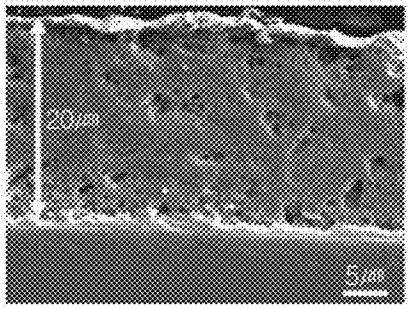
FIG. 8(*a*) is a photograph showing a cross section of an example of a hot-dip Zn plated steel sheet according to another example of the present invention, and FIGS. 8(*b*)-(*f*) are photographs showing the results of electron probe microanalyzer (EPMA) mapping analysis for each element.
Figure 8B:
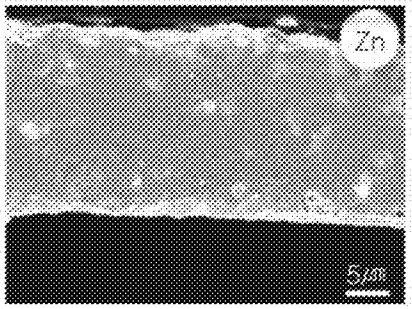
Figure 8C:
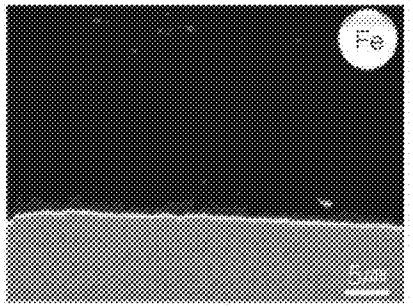
Figure 8D:
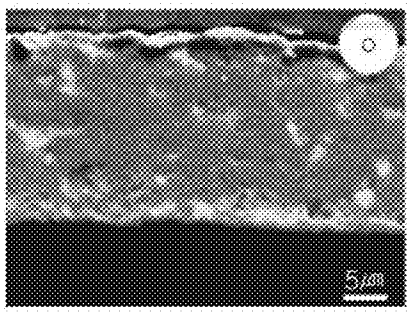
Figure 8E:
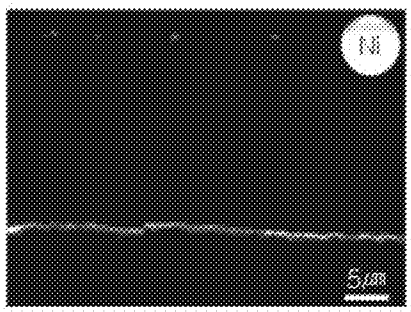
Figure 8F:
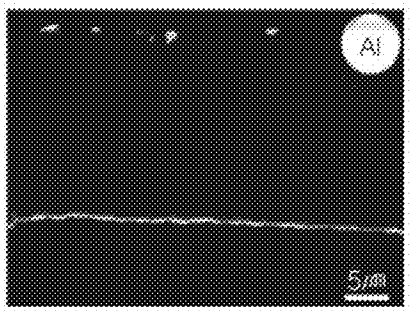

FIG. 7 schematically illustrates a cross-sectional view of a pressed part of the present invention, and a metal, in which a reduced amount of Gibbs free energy for one mole of oxygen during an oxidation reaction is smaller than that of Cr, is diffused into an uppermost portion of the base steel sheet to form a surface diffusion layer. Although not shown in FIG. 7, a structure may be obtained, in which an annealing oxide is non-uniformly distributed here and there on the surface diffusion layer and a larger amount of Al-rich layer is formed on the annealing oxide through an interfacial reaction with a metal in which a reduced amount of Gibbs free energy for one mole of oxygen during an oxidation reaction is smaller than that of Cr.

Al included in the Al-rich layer is diffused into a surface layer portion during a press heating process and is then selectively oxidized to form a dense and thin $Al_2O_3$ oxide coating layer which acts to prevent evaporation of Zn and oxide growth. Therefore, a process of forming the Al-rich layer after the immersion in the plating bath is essential in order to obtain a surface state of the hot-pressed part of the present invention. When the thickness of the Al-rich layer is less than 0.1 μm, the amount thereof is too small to continuously form the oxide coating layer, and when the thickness is greater than 1.0 μm, the oxide coating layer may be too thick. Therefore, the thickness of the oxide coating layer may be limited to a range of 0.1 μm to 1.0 μm.

Also, the area, in which portions having a content of the metal, in which a reduced amount of Gibbs free energy for one mole of oxygen during an oxidation reaction is smaller than that of Cr, of 5 wt % or more are overlapped among the Al-rich layer and the surface diffusion layer during EPMA analysis, may be 10% or less with respect to the total surface diffusion layer and Al-rich layer, and the overlapped portions denote that the metal and Al generate an alloy reaction to form an alloy phase. Since diffusion of Al into the surface of the plating layer during press heating is not facilitated when Al exists in a state alloyed with the metal, an amount of Al able to contribute to forming the continuous $Al_2O_3$ oxide coating layer substantially decreases when the portion existing in an alloyed state is large. Therefore, when the area of the overlapped portions is 10% or less during EPMA analysis, Al existing in a non-alloyed state is sufficiently included in the Al-rich layer to thus effectively form an $Al_2O_3$ oxide coating layer.

Meanwhile, the base steel sheet may include 0.1 wt % to 0.4 wt % of carbon (C), 2.0 wt % or less (excluding 0 wt %) of Si, 0.1 wt % to 4.0 wt % of Mn, and Fe as well as unavoidable impurities as a remainder.

Carbon (C): 0.1 wt % to 0.4 wt %

C is a key element for increasing strength of a steel sheet and generates hard phases of austenites and martensites. When a content of C is less than 0.1%, target strength may be difficult to obtain, even in the case that hot press is performed in an austenite single-phase region. Therefore, the content of C may be added to 0.1% or more. When the content of C is more than 0.4%, toughness and weldability may decrease and strength may excessively increase, and thus, there may be limitations in manufacturing processes, such as obstruction of mass flow in annealing and plating processes. Therefore, an upper limit of C is limited to 0.4% or less.

Manganese (Mn): 0.1 wt % to 4.0 wt %

Mn is an element for solid-solution strengthening, which not only greatly contributes to increased strength, but also plays an important role in delaying microstructure transformation from austenite to ferrite. When a content of Mn is less than 0.1%, an austenite-to-ferrite transformation temperature (Ae3) increases, and thus, a heat treatment temperature increased to such an extent is required in order to press forming a steel sheet in an austenite single phase. Meanwhile, when the content of Mn is greater than 4.0%, weldability and hot rolling property may deteriorate. At this time, for example, Mn may be included in an amount of 0.5% or more in order to decrease the ferrite transformation temperature (Ae3) by Mn and sufficiently secure hardenability.

Silicon (Si): 2.0 wt % or Less (Excluding 0 wt %)

Si is an element added for the purpose of deoxidization. When a content of Si is greater than 2%, a non-pickled hot-rolled steel sheet due to difficulties in pickling of the hot-rolled sheet and surface scale defects due to non-pickled oxide may not only be generated, but bare spots may also be generated due to generation of $SiO_2$ oxide on a steel surface during annealing. Therefore, an upper limit of Si may be limited to be 2%.

Also, the base steel sheet may further include one or more selected from the group consisting of (in wt %) 0.001 to 0.02% of nitrogen (N), 0.0001 to 0.01% of boron (B), 0.001 to 0.1% of titanium (Ti), 0.001 to 0.1% of niobium (Nb), 0.001 to 0.1% of vanadium (V), 0.001 to 1.0% of chromium (Cr), 0.001 to 1.0% of molybdenum (Mo), 0.001 to 0.1% of antimony (Sb), and 0.001 to 0.3% of tungsten (W).

Nitrogen (N): 0.001 wt % to 0.02 wt %

Since manufacturing costs for controlling N in a steel making process may greatly increase when a content of N is less than 0.001%, a lower limit thereof is determined as 0.001%. When the content of N is greater than 0.02%, manufacturing costs may increase because melting and continuous casting processes in the case of steel sheets are difficult in terms of a manufacturing process, and cracks in a slab due to AlN may be facilitated. Therefore, an upper limit thereof is determined as 0.02%.

Boron (B): 0.0001 wt % to 0.01 wt %

B is an element delaying an austenite-to-ferrite transformation. When a content of B is less than 0.0001%, its effect may be insufficiently obtained, and when the content of B is greater than 0.01%, its effect is saturated as well as hot workability being decreased. Therefore, an upper limit thereof may be limited to 0.01%.

Titanium (Ti), Niobium (Nb), or Vanadium (V): 0.001 wt % to 0.1 wt %

Ti, Nb, and V are effective elements for increasing strength of a steel sheet, refining grain size, and improving heat treatability. When contents of Ti, Nb, and v are less than 0.001%, effects therefrom may not sufficiently obtained, and when the contents are greater than 0.1%, desired effects of increasing strength and yield strength may not be expected due to increases in manufacturing costs and the generation of excessive carbonitrides. Therefore, upper limits thereof may be limited to 0.1%.

Chromium (Cr) or Molybdenum (Mo): 0.001 wt % to 1.0 wt %

Since Cr and Mo not only increase hardenability but also increase toughness of a heat-treatable steel sheet, its effects may be greater when added to a steel sheet requiring high impact energy. When a content of Cr or Mo is less than 0.001%, its effects may not be sufficiently obtained, and when the content of Cr or Mo is greater than 1.0%, its effects are not only saturated but manufacturing costs may also increase. Therefore, an upper limit thereof may be limited to 1.0%.

Antimony (Sb): 0.001 wt % to 0.1 wt %

Sb is an element for preventing selective oxidation of grain boundaries during hot rolling to generate uniform scaling and improve hot-rolled steel pickling properties. When a content of Sb is less than 0.001%, its effect may not be obtained, and when the content of Sb is greater than 0.1%, its effect is not only saturated but also manufacturing costs may increase and embrittlement may occur during hot working. Therefore, an upper limit thereof may be limited to 0.1%.

Tungsten (W): 0.001 wt % to 0.3 wt %

W is an element for improving heat treatment hardenability of a steel sheet and at the same time, for advantageously acting to secure strength due to W-containing precipitates. When a content of W is less than 0.001%, its effect may not be sufficiently obtained, and when the content of W is greater than 0.3%, its effect is not only saturated but manufacturing costs may also increase. Therefore, the content thereof may be limited to a range of 0.001% to 0.3%.

When a thickness of the zinc plating layer is 3 μm or more, heat resistance properties at high temperatures may be secured, and when the thickness is less than 3 μm, the plating layer may have a non-uniform thickness or corrosion resistance may be decreased therein. For example, it may be effective that the zinc plating layer has a thickness of 5 μm or more. Also, corrosion resistance may be secured as the plating layer is thicker, but sufficient corrosion resistance may be obtained when the thickness of the plating layer is about 30 μm. An upper limit of the thickness of the zinc plating layer may be determined as 30 μm in terms of economic factors and for example, the thickness of the plating layer is controlled to be within 15 μm to secure a high ratio of an alloy phase having a Fe content of 60 wt % or more in the plating layer after hot-pressing, and thus, it may be possible to prevent cracks able to be generated on a surface during press forming as much as possible.

[Hot-Pressed Part]

Hereinafter, a hot-pressed part of the present invention will be described in detail.

Another aspect of the present invention provides a hot-pressed part including: a base steel sheet; a zinc plating layer including a Fe—Zn phase having a metal, in which a reduced amount of Gibbs free energy for one mole of oxygen during an oxidation reaction is smaller than that of Cr, dissolved in an amount of about 0.008 wt % or more formed on the base steel sheet; and an oxide layer having an average thickness range of 0.01 μm to 5 μm formed on the zinc plating layer.

The metal, in which a reduced amount of Gibbs free energy for one mole of oxygen during an oxidation reaction is smaller than that of Cr, may be dissolved in an amount of 0.008 wt % or more in the Fe—Zn phase of the hot-dip zinc plating layer after hot press forming. That is, the metal, in which a reduced amount of Gibbs free energy for one mole of oxygen during an oxidation reaction is smaller than that of Cr, is included in an amount of 0.01 wt % or more in the plating layer before hot pressing and the metal, in which a reduced amount of Gibbs free energy for one mole of oxygen during an oxidation reaction is smaller than that of Cr, is dissolved in the Fe—Zn phase by hot press heating. Thus, when the metal, in which a reduced amount of Gibbs free energy for one mole of oxygen during an oxidation reaction is smaller than that of Cr, is included in an amount of 0.008 wt % or more in a ternary phase, diffusion of components in the base steel sheet into the plating layer may be prevented and simultaneously, diffusion of Zn in the zinc plating layer into the base steel sheet may be prevented.

A thickness of the oxide layer may be in a range of 0.01 μm to 5 μm or less. When the thickness of the oxide layer formed on a surface of the hot-dip zinc plating layer is greater than 5 μm, the oxide may be brittle and growing stress may be concentrated to facilitate delamination of the oxide at the surface, and thus, an oxide removal process such as shot blasting is required after product formation. Therefore, there is a need for controlling the thickness of the oxide layer to be 5 μm or less. However, when the thickness thereof is less than 0.01 μm, evaporation of Zn in the plating layer may not be prevented. Therefore, a lower limit of the thickness may be limited to 0.01 μm.

At this time, the oxide layer may include a continuous coating layer having an average thickness range of 10 nm to 300 nm and formed of one or more oxides selected from the group consisting of $SiO_2$ and $Al_2O_3$. In particular, $Al_2O_3$ oxide is mainly formed, $Al_2O_3$ oxide is formed alone, and some $SiO_2$ oxide may be included. Since these oxide layers are dense and chemically very stable, the oxide layers even in a very thin coating layer form may act to protect the surface of the plating layer at high temperatures. In particular, the oxide coating layer may be continuously formed in order to effectively play an effective role in protecting the plating layer by preventing the evaporation of Zn. When there is a discontinuous portion, oxidation of the plating layer may rapidly occur at the portion and thus, the plating layer may not be properly protected.

Also, the present inventors discovered that coatability and coating layer adhesion during electrodeposition coating as well as heat resistance of the plating layer may be greatly improved when a continuous coating layer is formed on the foregoing oxide layer. Typically, a phosphate treatment must be performed due to poor coatability during electrodeposition coating or a delamination phenomenon of the formed coating layer. However, as in the present invention, when the oxide layer including a continuous coating layer is formed on the plating layer, electrodeposition coatability and coating layer adhesion may be secured without a separate phosphate treatment. Therefore, great improvements may be obtained in terms of economic factors and manufacturing efficiency.

Also, the one or more oxides selected from the group consisting of $SiO_2$ and $Al_2O_3$ may not only be continuous, but thicknesses thereof may be within a range of 10 nm to 300 nm. When the thicknesses are less than 10 nm, the continuous coating layers may not only be difficult to be formed but the oxides may not sufficiently play a role in protecting the evaporation of Zn, because the oxides are too thin. When the thicknesses are greater than 300 nm, weldability may deteriorate due to very large amount of the oxides. Therefore, the thicknesses thereof may be limited to a range of 10 nm to 300 nm.

Also, the oxide layer includes ZnO and may include 0.01 wt % to 50 wt % of one or more oxides selected from the group consisting of MnO, $SiO_2$, and $Al_2O_3$. Since an oxide composed of ZnO grows fast due to a high internal diffusion rate at a high temperature, the oxide may not protect the plating layer. However, the oxide may function as a protective oxide coating layer able to protect the plating layer as well as the growth of the oxide layer being inhibited by including the oxide composed of MnO, $SiO_2$, and $Al_2O_3$ in an amount of 0.01 wt % or more in addition to ZnO. When the content of the oxide is greater than 50 wt %, weldability may deteriorate. Therefore, an upper limit may be limited to 50 wt %.

At this time, an oxide including ZnO and MnO is formed on the continuous coating layer and a content of MnO may be smaller than that of ZnO. Since a Mn component is diffused into the plating layer from the base steel sheet and a MnO oxide is then formed on the surface of the plating layer, the fact that the MnO oxide is formed in an amount larger than that of the ZnO denotes that diffusion excessively occurs to such an extent that the surface oxide layer is rapidly generated. Also, since ZnO has excellent electrical conductivity which is favorable to electrodeposition coating and phosphate treatment, the content of MnO may be lower than that of ZnO.

Also, the oxide layer may include 10 wt % or less of FeO. When a ratio of FeO in the oxide layer is greater than 10 wt %, it means that a large amount of Fe may diffuse through the plating layer from the base steel sheet and move into the surface to form the oxide. As a result, a uniform plating layer having a Zn content of 30% or more may not be formed and continuity of the protective oxide coating layer composed of $Al_2O_3$ or $SiO_2$ formed on the surface may be broken by the diffusion of Fe. Therefore, a proper ratio of FeO among oxides formed on a surface of the hot-pressed part obtained in the present invention may be less than 10 wt %. There is no separate restriction on a lower limit, because the smaller the amount of FeO, the better it is.

Meanwhile, a zinc diffusion phase may non-uniformly exist at an upper portion of the base steel sheet. In general, when the hot-dip zinc plated steel sheet is introduced into a hot press heating furnace, zinc included in the plating layer is diffused into the base steel sheet to continuously form a zinc diffusion phase having a predetermined thickness at an upper portion of the base steel sheet. This means that heat resistance is poor because a Zn content in the plating layer is insufficient due to excessive alloying. As a result, the zinc plating layer may not exhibit a corrosion resistant effect. Therefore, the zinc diffusion phase may be non-uniformly formed in order to secure heat resistance and corrosion resistance.

According to the present invention, since a ternary phase of Zn, Fe, and the metal, in which a reduced amount of Gibbs free energy for one mole of oxygen during an oxidation reaction is smaller than that of Cr, is formed at an interface between the plating layer and the base steel sheet to prevent diffusion of the components in the base steel into the plating layer and simultaneously, inhibit the diffusion of Zn included in the plating layer into the base steel sheet, the zinc diffusion phase is formed non-uniformly and this means that the diffusion of Zn out of the plating layer is well prevented. Therefore, excellent corrosion resistance may be secured.

Also, an average thickness of the zinc diffusion phase may be 5 μm or less. When the zinc diffusion phase is too thick, this means that a considerable amount of zinc included in the plating layer is diffused into the base steel sheet by hot press heating as in the continuous zinc diffusion phase, and in this case, there must be limitations in securing excellent heat resistance and corrosion resistance. That is, there is a need for controlling the average thickness of the zinc diffusion phase to be 5 μm or less in order to secure excellent heat resistance and corrosion resistance of the hot-pressed part. The zinc diffusion phase may not be continuously formed to a length of 1000 μm or more along the surface of the base steel sheet. Herein, the term "average thickness" denotes an average of thicknesses of alloy phases observed in a predetermined distance of 2000 μm or more.

Phases including zinc in the hot-dip zinc plated steel sheet are zinc plating layer and zinc diffusion phase, and the zinc diffusion phase in the present invention denotes a portion containing Zn that is not dissolved in an acidic solution and remains on the surface of the base steel sheet when the steel sheet is immersed in the acidic solution, such as a HCl solution including an inhibitor. Therefore, presence and composition of the zinc diffusion phase may be confirmed by measuring a thickness of the zinc diffusion phase remaining after dissolving the zinc-plated steel sheet in the acidic solution as in the above or a content of Zn included therein.

The content of Zn included in the zinc diffusion phase described in the present invention is less than 30 wt %. Since a portion having a Zn content of 30 wt % or more constitutes a portion of the zinc plating layer, a large amount of Fe is diffused to allow a portion having a Zn content of less than 30 wt % to become a zinc diffusion phase. As a result, difference between the zinc plating layer and the base steel sheet becomes unclear.

Accordingly, the zinc plating layer may be stably maintained by securing 30 wt % or more of the Zn content in the hot-dip zinc plating layer after hot press forming of the present invention. That is, since a loss of Zn in the zinc plating layer may be prevented by the foregoing ternary phase and oxide layer formed after hot press forming, the zinc plating is stably maintained and thus, the Zn content of the plating layer may be 30 wt % or more. When the Zn content of the plating layer is less than 30 wt %, a uniform plating layer may not be formed and corrosion resistance may easily deteriorate because sacrificial anode properties of the plating layer become poor.

At this time, a thickness of the hot-dip zinc plating layer after hot press forming may be 1.5 times larger than that before the hot press forming. In general, since higher Fe diffusion in the base steel sheet occurs by heating during a hot press process, the plating layer becomes thicker than that before the plating layer is subjected to the hot press process. In particular, when the thickness of the zinc plating layer in the present invention is denoted as a distance between a surface of the hot pressed steel sheet and a position at which the content of Zn in the plating layer is 30 wt % or more, the thickness is controlled to be 1.5 times or more larger than that before press forming in order to secure sufficient corrosion resistance.

In an initial period of press heating, the average thickness of the oxide non-uniformly distributed on the metal surface diffusion layer disposed on the uppermost portion of the base steel sheet is controlled to be 150 nm or less to promote alloying and thus, heat resistance may be secured by rapidly increasing the melting point of the zinc plating layer. When the press heating continues to obtain a temperature of 750° C. or more, the metal is enriched in the Zn—Fe phase to form a ternary phase that prevents excessive alloying, and thus, the zinc plating layer may be stably maintained. That is, it is advantageous in the initial period of press heating that alloying is performed fast, and on the other hand, when the temperature is 750° C. or more, inhibition of alloying is favorable to maintain the zinc plating layer. In the present invention, heat resistance may be secured by controlling both of them.

Meanwhile, a ratio of an alloy phase having a Fe content of 60 wt % or more in the zinc plating layer may be 70 wt % or more with respect to the total zinc plating layer. Based on observations, in which since an amount of Zn becomes large when a Fe-rich phase is insufficient in the plating layer, an effect of increasing the melting point by Fe—Zn alloying may be insignificant, and as a result, Zn existing in a liquid phase is generated in the zinc plating layer during hot press heating and the liquid phase Zn may flow into the base steel sheet during hot press working to generate cracks on the surface of the base steel sheet, the inventors of the present invention conducted significant amount of research and found that cracks may be generated on the surface of the base steel sheet during hot press working when the Fe-rich alloy phase having a Fe content of 60 wt % or more is included in an amount of less than 70 wt % with respect to the total plating layer.

Since a sufficient amount of processing may not be applied in order to prevent the crack generation, processability may decrease. Accordingly, the present inventors have invented a hot-pressed part able to effectively prevent the crack generation and having excellent processability by including 70 wt % or more of the Fe-rich alloy phase having a Fe content of 60 wt % or more in the plating layer.

The metal, in which a reduced amount of Gibbs free energy for one mole of oxygen during an oxidation reaction is smaller than that of Cr, may be one or more selected from the group consisting of Ni, Fe, Co, Cu, Sn, and Sb. Also, the base steel sheet may include 0.1 wt % to 0.4 wt % of C, 2.0 wt % or less (excluding 0 wt %) of Si, 0.1 wt % to 4.0 wt % of Mn, and Fe as well as unavoidable impurities as a remainder. Also, the base steel sheet may further include one or more selected from the group consisting of 0.001 to 0.02% of N, 0.0001 to 0.01% of B, 0.001 to 0.1% of Ti, 0.001 to 0.1% of Nb, 0.001 to 0.1% of V, 0.001 to 1.0% of Cr, 0.001 to 1.0% of Mo, 0.001 to 0.1% of Sb, and 0.001 to 0.3% of W.

[Method of Manufacturing Hot-Pressed Part]

Hereinafter, a method of manufacturing a zinc-plated steel sheet and a hot-pressed part of the present invention will be described in detail.

Another aspect of the present invention provides a method of manufacturing a hot-pressed part including: coating a metal, in which a reduced amount of Gibbs free energy for one mole of oxygen during an oxidation reaction is smaller than that of Cr, on a steel sheet; annealing the coated steel sheet within a temperature range of 700° C. to 900° C.; zinc plating the annealed steel sheet by dipping in a molten zinc plating bath having a temperature range of 430° C. to 500° C. and including 0.05 wt % to 0.5 wt % of Al and Zn as well as unavoidable impurities as a remainder; heating the zinc-plated steel sheet to a temperature within a temperature range of 750° C. to 950° C. at a heating rate ranging from 2° C./sec to 10° C./sec in an oxidizing atmosphere and maintaining a temperature for 10 minutes or less; and press forming the heated and temperature-maintained steel sheet within a temperature range of 600° C. to 900° C.

In manufacturing the zinc-plated steel sheet and the hot-pressed part of the present invention, type of zinc plating method is not particularly limited. That is, hot-dip zinc plating may be used, or electrogalvanizing may be used, or dry galvanizing by using plasma or zinc plating by using a high-temperature liquid phase Zn spray method may be performed. An aspect of the present invention suggests and describes a hot-dip zinc plating method as an example of the zinc plating method.

First, in the present invention, coating of a metal, in which a reduced amount of Gibbs free energy for one mole of oxygen during an oxidation reaction is smaller than that of Cr, is performed on a steel sheet for hot pressing. As described above, the melting point of Zn is 420° C. and Zn is liquefied when it is put in a hot press heating furnace having a temperature range of 800° C. to 900° C., and thus, the plating layer may disappear. Therefore, there is a need for increasing a melting temperature of Zn layer by rapidly alloying components of the steel sheet, such as Fe and Mn, into the Zn layer, while an initial temperature of the steel sheet increases in the heating furnace.

When the steel sheet is exposed at too high temperature or exposed at a high temperature for a long period of time, the plating layer is oxidized to form thick ZnO on a surface of the plating layer and thus, loss of the plating layer may be severe, and since active interdiffusion between Zn in the plating layer and base components of the steel sheet occurs to decrease a Zn content in the plating layer, corrosion resistance may decrease. Therefore, growth of the oxide on the surface of the plating layer must be minimized and the Zn content in the plating layer must be maintained above a predetermined amount.

In order to achieve the foregoing object, there is a need for coating the metal, in which a reduced amount of Gibbs free energy for one mole of oxygen during an oxidation reaction is smaller than that of Cr, on the surface of a steel sheet before the steel sheet is charged into an annealing furnace. The function of the coating is minimization of generation of an annealing oxide generated on the surface of the cold-rolled steel sheet in the annealing furnace. The annealing oxide acts as a diffusion barrier, which prevents alloying between the Zn plating layer and the components of the steel sheet, Fe and Mn. When the coating of the metal is performed to minimize the formation of the annealing oxide, alloying of Fe and Mn into the Zn layer is promoted and thus, the plating layer may have heat resistance in the heating furnace.

The annealing heat treatment may be performed in a temperature range of 700° C. to 900° C. in a mixed gas atmosphere in which nitrogen and hydrogen are mixed. A dew point temperature of the foregoing atmosphere may be −10° C. or less. A ratio of hydrogen ($H_2$) gas in the mixed gas may be in a range of 3 vol % to 15 vol % and the remainder may be nitrogen ($N_2$) gas. When the ratio of $H_2$ is less than 3%, reducing power of the atmosphere gas decreases to facilitate the generation of the oxide, and when the ratio of $H_2$ is greater than 15%, reducing power increases but increases in manufacturing costs are too high with respect to the increase in the reducing power and thus, economic factors are unfavorable.

When the annealing heat treatment temperature is less than 700° C., material characteristics of the steel may not be secured due to the too low annealing temperature, and when the annealing temperature is greater than 900° C., a thin oxide coating layer may not be formed between the steel sheet and the hot-dip zinc plating layer in the present invention, because a growth rate of the oxide becomes fast. Also, when the dew point temperature of the foregoing atmosphere is more than −10° C., the growth rate of the oxide also becomes fast.

Also, for example, the hot-dip zinc plating may be performed on the annealed steel sheet by dipping in a plating bath having a temperature range of 430° C. to 500° C. and including 0.05 wt % to 0.5 wt % of Al and Zn as well as unavoidable impurities as a remainder. When a content of Al is less than 0.05%, the plating layer may be non-uniformly formed, and when the content of Al is greater than 0.5%, a thick inhibition layer is formed at an interface of the Zn plating layer to decrease diffusion rates of Fe and Mn into the Zn layer at an initial period of a reaction in a hot press heating furnace and thus, alloying in the heating furnace may be delayed. Therefore, the content of Al may be limited to 0.5% or less and for example, it may be more effective in preventing the delay of the alloying by controlling the content of Al to be 0.25% or less.

Other plating conditions may be in a range with typical methods, but the plating may be performed within a plating bath temperature range of 430° C. to 500° C. When the plating bath temperature is less than 430° C., the plating bath may not have sufficient fluidity, and on the other hand, when the plating bath temperature is greater than 500° C., production efficiency may decrease because dross is frequently generated in the plating bath. Therefore, the plating bath temperature may be controlled to be within a range of 430° C. to 500° C. For example, when the temperature is controlled to be 460° C. or more, it may be more effective in sufficiently enriching the metal having an oxidizing potential lower than that of Cr and Al at an interface between the plating layer and the base steel sheet.

The hot-dip zinc plating is performed to obtain a thickness range of 5 μm to 30 μm. When the thickness of the hot-dip zinc plating layer is less than 5 μm, alloying in the plating layer may excessively occur in the hot press heating furnace to significantly decrease the Zn content in the plating layer after hot pressing. When the thickness of the plating layer is greater than 30 μm, alloying of the plating layer in the hot press heating furnace may be delayed to rapidly grow the oxide on the surface of the plating layer. Since it is also unfavorable in terms of manufacturing costs, the thickness of the hot-dip zinc plating layer is limited to be within 30 μm.

At this time, the coating of the metal, in which a reduced amount of Gibbs free energy for one mole of oxygen during an oxidation reaction is smaller than that of Cr, may be performed by coating one or more selected from the group consisting of Ni, Fe, Co, Cu, Sn, and Sb in an average thickness range of 1 nm to 1000 nm. The metal used for the coating must be composed of a metal, in which a reduced amount of Gibbs free energy in the formation of metal oxide for one mole of oxygen is smaller than that of Cr. When the reduced amount of Gibbs free energy is greater than that of Cr, the coated metal itself is oxidized and thus, there is no improvement effect. Ni and Fe are typically used as the metal. In addition, Co, Cu, Sn, and Sb may be used and the coating may be performed in a state of mixture or alloy thereof. For example, Fe may be coated in an alloy state.

At this time, a coating thickness of the metal may be in a range of 1 nm to 1000 nm. When the coating thickness is less than 1 nm, the annealing oxide may not be sufficiently inhibited, and when the coating thickness is greater than 1000 nm, the inhibition of oxide formation by metal coating may be possible. However, since it is economically unfavorable due to increases in manufacturing costs, the coating thickness is limited to be within 1000 nm. Therefore, the thickness may be controlled to be within a range of 1 nm to 1000 nm, and for example, when the thickness is controlled to be within a range of 10 nm to 200 nm, the inhibition of oxide formation may be more secured and simultaneously, it may be more favorable in terms of economical factors.

Also, performing an alloying heat treatment at a temperature of 600° C. or less may be further included after the dipping in the molten zinc plating bath. When the alloying heat treatment is performed after the plating, an alloying heat treatment temperature is limited to 600° C. or less. When the temperature is greater than 600° C., alloying of the plating layer is performed to increase heat resistance in the hot press heating furnace. However, since cracks may be generated due to embrittlement of the plating layer and growth of scaling on the surface of the plating layer may increase, the alloying heat treatment temperature is limited to 600° C. or less and may be limited to 500° C. or less to control the content of Fe in the plating layer to be 5 wt % or less, and thus, the generation of microcracks in the plating layer may be effectively prevented. When the temperature is limited to 450° C. or less, the generation of microcracks may be further prevented.

The hot-dip zinc plated steel sheet is manufactured and a hot press process is then performed. First, a heat treatment process is performed on the hot-dip zinc plated steel sheet. The heat treating may be performed by heating within a temperature range of 750° C. to 950° C. at a heating rate ranging from 2° C./sec to 10° C./sec in an oxidizing atmosphere and maintaining a temperature for 10 minutes or less. The reason for this is that when the heating rate is less than 2° C./sec, the plating layer may deteriorate because holding time in the heating furnace is too long, and when the heating rate is greater than 10° C./sec, temperature of the plating layer excessively increases in a state in which alloying of the zinc plating layer is insufficiently completed, and thus, the zinc plating layer may deteriorate.

A maximum temperature during heating is within a range of 750° C. to 950° C. and holding time at the maximum temperature may be 10 minutes or less. When the maximum is less than 750° C., strength may not be secured because a microstructure of the steel is insufficiently transformed into an austenite region, and an upper limit of the temperature may be limited to 950° C. in terms of economic factors. Also, since surface qualities of the plating layer may deteriorate when the holding time at the foregoing temperature is too long, the holding time may not exceed more than 30 minutes, and for example, it may be effective in limiting the holding time within 10 minutes.

In particular, when the steel sheet is heated within a temperature range of 750° C. to 950° C. in an oxidizing atmosphere, an $Al_2O_3$ layer is formed on the surface of the steel sheet to act as a protective layer which inhibits evaporation of Zn in the plating layer. In order to continuously form the protective layer, an oxygen partial pressure in a heating atmosphere may be $10^{-40}$ atm or more, and for example, the protective layer may be more smoothly formed when the oxygen partial pressure is $10^{-5}$ atm or more.

After the foregoing heat treatment, press forming is performed within a temperature range of 600° C. to 900° C. to manufacture a hot-pressed part. Since austenites are transformed into ferrites when the temperature is less than 600° C., sufficient strength may not be secured even in the case that hot pressing is performed, and an upper limit of the temperature may be limited to 900° C. in terms of economic factors.

MODE FOR INVENTION

Hereinafter, the present invention will be described in detail according to examples. However, the following examples are merely provided to allow for a clearer understanding of the present invention, rather than to limit the scope thereof.

EXAMPLE 1

First, in order to investigate thicknesses of annealing oxides after an annealing heat treatment according to the presence of metal coating, a steel sheet having a composition of 0.24 wt % C—0.04 wt % Si—2.3 wt % Mn—0.008 wt % P—0.0015 wt % S—0.025 wt % Al was coated with Ni or was uncoated, and an annealing heat treatment was then performed at 785° C. and zinc plating was performed. Thereafter, an average thickness of an annealing oxide formed on a metal surface diffusion layer in a base steel sheet was measured for each sample and the results thereof are presented in Table 1. The thickness of the annealing oxide was measured by GOEDS (energy dispersive electron spectroscopy) analysis and TEM (transmission electron microscope) cross-sectional analysis. The thickness of the annealing oxide was estimated by a position at which a content of oxygen decreased to 10 wt % and platability was evaluated. Thereafter, a hot press forming (HPF) process was performed on the hot-dip zinc plated steel sheet and then the presence of a plating layer was confirmed.

TABLE 1

| Category | Ni coating thickness (nm) | Annealing oxide thickness (nm) | Platability evaluation | Presence of plating layer after HPF |
|---|---|---|---|---|
| Comparative Example 1 | Non coating | 170 | Non plating | Unable to perform HPF |
| Inventive Example 1 | 10 | 115 | Good | Good |

TABLE 1-continued

| Category | Ni coating thickness (nm) | Annealing oxide thickness (nm) | Platability evaluation | Presence of plating layer after HPF |
|---|---|---|---|---|
| Inventive Example 2 | 25 | 83 | Good | Good |
| Inventive Example 3 | 40 | 50 | Very good | Very good |
| Inventive Example 4 | 50 | 45 | Very good | Very good |

According to the results of measurements for Inventive Examples 1 to 4, the thicknesses of the annealing oxides were controlled to be 150 nm or less by Ni coatings, and thus, platability was excellent and the plating layers were stably maintained after HPF. In particular, with respect to Inventive Examples 3 and 4 in which the thicknesses of the annealing oxides were controlled to be 50 nm or less, platability was very good.

On the other hand, since Ni coating was not performed in Comparative Example 1, too thick annealing oxide was formed. As a result, plating was unable to be performed and thus, the plating layer was unstably maintained after the HPF process.

EXAMPLE 2

Table 2 presents manufacturing methods of materials, such as coating amounts of metals, initial thicknesses of Zn layers, concentrations of Al in a Zn bath, and alloying temperatures, thicknesses of plating layers after hot pressing, thicknesses of oxides formed on the plating layers, and content ratios of Zn in the plating layers. The content ratios of Zn in the plating layers were listed as composition ratios of Zn in the plating layers during GOEDS analyses.

TABLE 2

| No. | Presence of metal coating | Metal coating thickness (nm) | Annealing temperature (° C.) | Zn plating layer thickness (μm) | Al content in Zn bath (wt %) | Alloying temperature (° C.) | Hot pressing temperature (° C.) | Plating layer thickness after hot pressing (μm) | Oxide layer thickness after hot pressing (μm) | Zn ratio in plating layer (wt %) | remarks |
|---|---|---|---|---|---|---|---|---|---|---|---|
| 1 | Ni | 50 | 785 | 14 | 0.126 | 400 | 890 | 24 | 1 or less | 55 | Inventive Steel 1 |
| 2 | Ni | 50 | 785 | 14 | 0.126 | — | 900 | 19 | 1 or less | 40 | Inventive Steel 2 |
| 3 | Ni | 25 | 785 | 14 | 0.126 | — | 800 | 20 | 1 or less | 73 | Inventive Steel 3 |
| 4 | Ni | 55 | 800 | 15 | 0.126 | 400 | 850 | 22 | 1 or less | 52 | Inventive Steel 4 |
| 5 | Ni | 55 | 900 | 19 | 0.056 | — | 900 | 26 | 1 or less | 37 | Inventive Steel 5 |
| 6 | — | — | 785 | 4 | 0.126 | 400 | 850 | — | 6 | 2 | Comparative Steel 1 |
| 7 | Ni | 15 | 785 | 7 | 0.126 | 560 | 850 | 13 | 2-5 | 32 | Inventive Steel 6 |
| 8 | Ni | 50 | 785 | 12 | 0.126 | 540 | 850 | 15 | 2-4 | 31 | Inventive Steel 7 |
| 9 | — | — | 785 | 10 | 0.22 | — | 900 | 12 | 5.5 | 5 | Comparative Steel 2 |
| 10 | Ni | 50 | 785 | 11 | 0.126 | — | 800 | 17 | 2 | 59 | Inventive steel 8 |

According to the test results, with respect to Inventive Steels of the present invention, Zn in the plating layers after hot pressing were 30% or more and the oxide layers after hot pressing had low thicknesses of 5 μm or less, and thus, the plating layers were stably formed. In particular, Zn ratios in the plating layers of Inventive Steels 1 to 5 having thicknesses of less than 1.5 μm were 37% or more and thus, it may be confirmed that heat resistances may be more secured. On the other hand, with respect to Comparative Steels, Ni plating was not performed and thus, the Comparative Steels were formed without regard for the purpose of the present invention, such as Zn ratios in the plating layers were low or thicknesses of the oxide layers after hot pressing were excessively high.

FIG. 1 is a photograph showing a cross section of a hot-dip Zn plated steel sheet of Inventive Steel 1 after hot press forming. As shown in FIG. 1, it may be confirmed that the thickness of the oxide layer on the surface of the zinc plating layer was 5 μm or less and the plating layer was uniformly formed.

Figure 2:
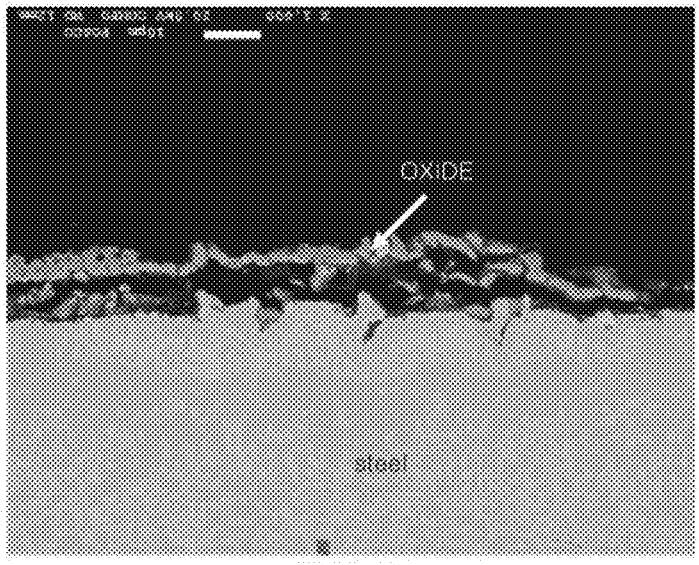
FIG. 2 is a photograph showing a cross section of a hot-dip Zn plated steel sheet after hot press forming according to a Comparative Example.

FIG. 2 is a photograph showing a cross section of a hot-dip Zn plated steel sheet of Comparative Steel 1 after hot press forming. Referring to FIG. 2, it may be confirmed that a boundary of a Zn alloying layer was unclear, a content of Zn in the Zn alloying layer was less than 30%, and an oxide layer also had a high thickness of more than 5 μm.

EXAMPLE 3

First, experiments were conducted on steel sheets obtained by cold rolling steels having compositions listed in Table 3.

TABLE 3

| Category (wt %) | C | Mn | Si | N (ppm) | B (ppm) | Ti | Nb | V | Cr | Mo | Sb | W |
|---|---|---|---|---|---|---|---|---|---|---|---|---|
| Steel 1 | 0.17 | 1.4 | 0.35 | 116 | — | — | — | — | — | — | — | — |
| Steel 2 | 0.24 | 2.3 | 0.4 | 120 | 20 | 0.002 | — | — | 0.003 | — | — | — |
| Steel 3 | 0.22 | 1.7 | 1.0 | 115 | 30 | — | 0.01 | — | — | 0.005 | 0.01 | — |
| Steel 4 | 0.32 | 1.5 | 1.5 | 110 | — | — | — | — | — | — | — | — |
| Steel 5 | 0.33 | 1.6 | 0.45 | 125 | 20 | 0.05 | 0.005 | 0.001 | 0.01 | 0.003 | — | — |
| Steel 6 | 0.24 | 0.5 | 0.5 | 50 | 30 | — | — | — | — | — | — | — |
| Steel 7 | 0.22 | 0.4 | 0.5 | 120 | 30 | 0.005 | — | 0.007 | 0.01 | — | 0.005 | 0.007 |
| Steel 8 | 0.22 | 1.8 | 0.43 | 115 | — | — | — | — | — | — | — | — |
| Steel 9 | 0.21 | 2.2 | 2.5 | 40 | — | — | — | — | — | — | — | — |

Surfaces of the steel sheets before annealing were coated with predetermined metals under conditions listed in the following Table 4 and hot-dip zinc plated steel sheets were then manufactured by annealing and Zn plating. Thicknesses of metal coating layers, contents of the metals enriched to depths of 1 μm from the surfaces, and thicknesses of Zn plating layers were measured through GOEDS analyses. In order to increase accuracy of data, the data were compared and verified by scanning electron microscope (SEM) and TEM observations on cross sections of samples, wet analyses, and electron spectroscopy for chemical analysis (ESCA) method.

Thereafter, hot-pressing processes were performed on the hot-dip zinc plated steel sheets, temperatures of the hot press heating furnace were in a range of 750° C. to 950° C., and heating furnace atmospheres were air atmospheres. The hot-pressing processes were completed and the thicknesses of the plating layers were then measured through analyses on the cross sections of the samples. For reference, the thicknesses of the plating layers were obtained by measuring lengths in a perpendicular direction from the surfaces to positions at which the contents of Zn in the plating layers were 30 wt % or more after hot pressing. Each experimental condition and measurement results are presented in Table 3.

TABLE 4

| Category | Steels | Coating metal type | Metal coating thickness (nm) | Annealing temperature (° C.) | Enriched metal content within 1 μm of surface layer (wt %) | Zn plating layer thickness (μm) |
|---|---|---|---|---|---|---|
| Inventive Example 1 | Steel 1 | Ni | 150 | 800 | 11 | 10 |

TABLE 4-continued

| | | | | | | |
|---|---|---|---|---|---|---|
| Inventive Example 2 | Steel 2 | Co | 50 | 785 | 4.4 | 14 |
| Inventive Example 3 | Steel 3 | Ni | 30 | 800 | 2.8 | 8 |
| Inventive Example 4 | Steel 4 | Ni | 20 | 800 | 1.7 | 8 |
| Inventive Example 5 | Steel 5 | Ni | 80 | 800 | 7.2 | 10 |
| Inventive Example 6 | Steel 6 | Ni | 30 | 820 | 2.5 | 11 |
| Inventive Example 7 | Steel 7 | Fe—Ni | 20 | 790 | 1.6 | 10 |
| Inventive Example 8 | Steel 8 | Ni | 50 | 790 | 0.8 | 8 |
| Comparative Example 1 | Steel 9 | Ni | 30 | 790 | 2.0 | 8 |
| Comparative Example 2 | Steel 1 | — | — | 800 | — | 7 |
| Comparative Example 3 | Steel 2 | — | — | 800 | — | 8 |

| Category | Alloying temperatue (° C.) | Hot press heating temperature (° C.) | Hot press heating time (min) | Plating layer thickness after hot pressing (μm) | Tensile strength of pressed part (Mpa) | Elongation of pressed part (%) |
|---|---|---|---|---|---|---|
| Inventive Example 1 | — | 910 | 5 | 20 | 1210 | 9 |
| Inventive Example 2 | — | 900 | 6 | 21 | 1578 | 7 |
| Inventive Example 3 | — | 930 | 5 | 21 | 1810 | 8 |
| Inventive Example 4 | 490 | 850 | 7 | 27 | 1250 | 9 |
| Inventive Example 5 | — | 900 | 7 | 26 | 1650 | 8 |
| Inventive Example 6 | — | 900 | 6 | 22 | 1310 | 9 |
| Inventive Example 7 | — | 900 | 5 | 19 | 2030 | 6 |
| Inventive Example 8 | — | 900 | 5 | 19 | 1280 | 9 |
| Comparative Example 1 | — | No HPF due to no plating | | | 1260 | 8 |
| Comparative Example 2 | — | 900 | 7 | — | 1220 | 9 |
| Comparative Example 3 | — | 900 | 6 | — | 1565 | 7 |

It may be confirmed that plating layers in Inventive Examples 1 to 8 were stably maintained even after hot press heating by enriching metals just under surface layers through metal coatings. Also, Steels 1 to 8 were used, in which all Steels 1 to 8 satisfied a component system and a composition range of the present invention, and it may be understood that tensile strengths and elongations of pressed parts were also very excellent.

In contrast, Ni was enriched just under a surface layer through Ni coating in Comparative Example 1. However, since Steel 9 was used, in which too much Si was added to a base steel sheet, and thus, a large amount of $SiO_2$ was formed on the surface after annealing to generate a non-plating phenomenon. As a result, a hot-pressing process was not preformed.

Also, Comparative Examples 2 and 3 used Steels 1 and 2 satisfying the composition range of the present invention. However, since metal coating treatments were not performed before zinc plating, metals were not enriched just under the surfaces, and as a result, it may be confirmed that securements of heat resistance were not possible because plating layers were entirely disappeared after hot press forming.

EXAMPLE 4

First, experiments were conducted on steel sheets obtained by cold rolling steels having compositions listed in Table 5.

TABLE 5

| Category (wt %) | C | Si | Mn | p | S | Al |
|---|---|---|---|---|---|---|
| Steel 1 | 0.24 | 0.04 | 2.3 | 0.008 | 0.0015 | 0.025 |
| Steel 2 | 0.22 | 1.0 | 1.7 | 0.01 | 0.001 | 0.04 |

Surfaces of the steel sheets before annealing were coated with predetermined metals within thicknesses of 200 nm and hot-dip zinc plated steel sheets were then manufactured by annealing at a temperature of 785° C. and Zn plating. Thicknesses of metal coating layers, contents of the metals enriched to depths of 1 μm from the surfaces, and thicknesses of Zn plating layers were measured through GOEDS analyses. In order to increase accuracy of data, the data were compared and verified by scanning electron microscope (SEM) and TEM observations on cross sections of the samples, wet analyses, and electron spectroscopy for chemical analysis (ESCA) method.

Thereafter, hot-pressing processes were performed on the hot-dip zinc plated steel sheets, temperatures of the hot press heating furnace were in a range of 750° C. to 950° C., and heating furnace atmospheres were air atmospheres. The hot-pressing processes were completed, and then oxides formed on the surfaces and alloy phases in the plating layers were analyzed through XRD and GOEDS analyses on the surfaces of the plating layers, and the thicknesses of the plating layers and continuities and thicknesses of Zn diffusion phases were measured through analyses on the cross sections of the samples. For reference, the thicknesses of the plating layers were obtained by measuring lengths in a perpendicular direction from the surfaces to positions at which the contents of Zn in the plating layers were 30 wt % or more. Each experimental condition and measurement results are presented in Table 6.

TABLE 6

| Category | Steels | Coating metal type | Metal coating thickness (nm) | Enriched metal content within 1 μm of surface layer (wt %) | Zn plating layer thickness (μm) | Alloying temperature (° C.) | Hot press heating temperature (° C.) | Hot press heating time (min) | Plating layer thickness after hot pressing (μm) | Continuity of Zn diffusion phase | Zn diffusion phase thickness (μm) |
|---|---|---|---|---|---|---|---|---|---|---|---|
| Inventive Example 1 | Steel 1 | Ni | 25 | 2.2 | 8 | — | 910 | 6 | 20 | Discontinuous | 3 |
| Inventive Example 2 | Steel 1 | Ni | 25 | 2.2 | 8 | 500 | 910 | 6 | 21 | Discontinuous | 3 |
| Inventive Example 3 | Steel 2 | Fe—Ni | 50 | 4.5 | 12 | — | 900 | 4 | 21 | Discontinuous | 2 |
| Inventive Example 4 | Steel 2 | Ni | 20 | 1.8 | 10 | — | 930 | 7 | 27 | Discontinuous | 4 |
| Comparative Example 1 | Steel 1 | — | — | | 8 | — | 910 | 6 | — | Continuous | 19 |
| Comparative Example 2 | Steel 2 | — | — | — | 10 | — | 900 | 5 | — | Continuous | 22 |
| Comparative Example 3 | Steel 2 | — | — | — | 10 | 560 | 900 | 6 | — | Continuous | 23 |

First, in Inventive Examples 1 to 4, Fe—Zn—Ni ternary phases were formed in plating layers through Ni coatings during hot press heating and thus, zinc diffusion phases occurred non-uniformly by preventing diffusion of zinc into base steel sheets and thicknesses of the zinc diffusion phases were also limited to low values of 3 μm or less. Therefore, since heat resistances were secured to stably maintain the Zn plating layers and as a result, corrosion resistances of the plating layers may be well exhibited.

In contrast, since Ni coatings were not performed in Comparative Examples 1 to 3, Zn in plating layers were rapidly diffused during hot press heating to form continuous and thick zinc diffusion phases. As a result, Zn plating layers were entirely disappeared and thus, heat resistances were not secured. Eventually, it may be confirmed that securements of corrosion resistance, i.e., the purpose of using zinc-plated steels, were not possible.

Figure 3:
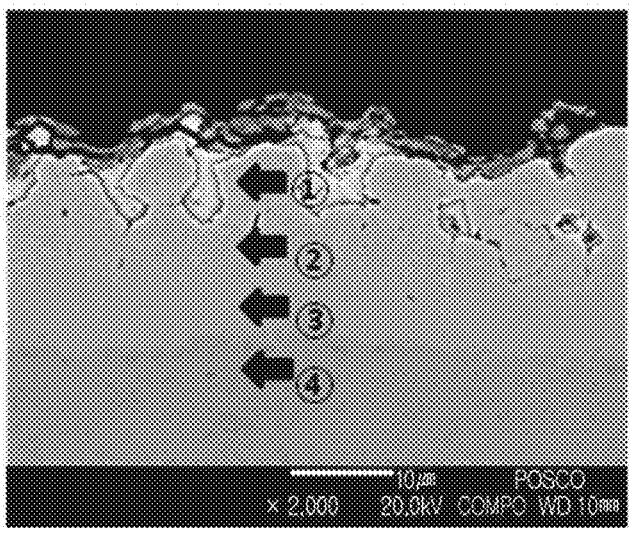
FIG. 3 is a cross section of a hot-pressed part manufactured according to another Inventive Example.
Figure 4:
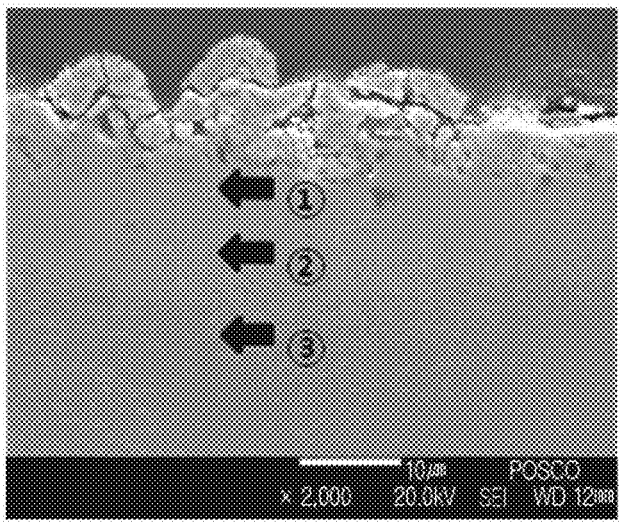
FIG. 4 is a cross section of a hot-pressed part manufactured according to another Comparative Example.

Also, in order to make the comparison more clear, the results of analyzing a cross section of a hot-pressed part manufactured according to Inventive Example 1 and compositions of each position by EDS are presented in FIG. 3 and Table 7, and the results of analyzing a cross section of a hot-pressed part manufactured according to Comparative Example 1 and compositions of each position by EDS are presented in FIG. 4 and Table 8.

TABLE 7

| Category (wt %) | ① | ② | ③ | ④ |
|---|---|---|---|---|
| Mn | — | — | — | 2.2 |
| Si | — | — | — | 0.3 |
| Fe | 67.65 | 67.85 | 68.05 | 97.5 |
| Zn | 32.35 | 32.15 | 31.95 | — |

TABLE 8

| Category (wt %) | ① | ② | ③ |
|---|---|---|---|
| Mn | — | — | 1.66 |
| Si | — | — | — |
| Fe | 80.47 | 83.71 | 96.16 |
| Zn | 19.08 | 16.29 | 2.18 |

First, referring to FIG. 3, it may be understood that distinction between a plating layer and a base steel sheet was clear because a zinc diffusion phase was almost not formed at an upper portion of the base steel sheet. That is, the plating layer did not disappear after hot press heating and was stably maintained. Referring to Table 7, it may be understood that positions ①, ②, and ③ were stable positions in the plating layer because ratios of Zn were more than 30 wt %, and position ④ was the upper portion of the base steel sheet and it may be understood that the formation of the zinc diffusion phase was very insignificant because zinc was almost not found. Therefore, heat resistance of the plating layer was well secured and as a result, corrosion resistance may also be effectively manifested.

In contrast, referring to FIG. 4, it may be understood that distinction between a plating layer and a base steel sheet was unclear because zinc diffusion excessively occurred. That is, heat resistance was not secured because most of Zn in the plating layer disappeared into the base steel sheet. Referring to Table 8, contents of Zn did not reach even 20 wt % at positions ① and ② which were positions in the plating layer before press heating and thus, it may not be regarded as a plating layer which may substantially exhibit corrosion resistance. Eventually, it may be understood that most of the zinc plating layer was disappeared to diffuse into a portion of the base steel sheet.

EXAMPLE 5

First, experiments were conducted on steel sheets obtained by cold rolling steels having compositions listed in Table 9.

TABLE 9

| Category (wt %) | C | Si | Mn | p | S | Al |
|---|---|---|---|---|---|---|
| Steel 1 | 0.17 | 0.25 | 1.4 | 0.01 | 0.001 | 0.02 |
| Steel 2 | 0.24 | 0.04 | 2.3 | 0.008 | 0.0015 | 0.025 |
| Steel 3 | 0.22 | 1.0 | 1.7 | 0.01 | 0.001 | 0.04 |

Surfaces of the steel sheets before annealing were coated with predetermined metals under conditions listed in the following Table 10 and hot-dip zinc plated steel sheets were then manufactured by annealing and Zn plating. Thicknesses of metal coating layers, contents of the metals enriched to depths of 1 μm from the surfaces, and thicknesses of Zn plating layers were measured through GOEDS analyses. In order to increase accuracy of data, the data were compared and verified by scanning electron microscope (SEM) and TEM observations on cross sections of the samples, wet analyses, and electron spectroscopy for chemical analysis (ESCA) method.

Thereafter, hot-pressing processes were performed on the hot-dip zinc plated steel sheets, temperatures of the hot press heating furnace were in a range of 750° C. to 950° C., and heating furnace atmospheres were air atmospheres. The hot-pressing processes were completed, and then oxides formed on the surfaces and alloy phases in the plating layers were analyzed through XRD and GOEDS analyses on the surfaces of the plating layers, and the thicknesses of the plating layers and ratios of phases (Fe-rich phases) having 60 wt % or more of Fe in the plating layers were measured through analyses on the cross sections of the samples.

For reference, the thicknesses of the plating layers were obtained by measuring lengths in a perpendicular direction from the surfaces to positions at which the contents of Zn in the plating layers were 30 wt % or more after hot pressing. In order to investigate cracks in processed parts, cross sections of the parts processed with a radius of curvature of 12 mm were cut to measure depths of the cracks generated in a direction of the base steel sheet. Each experimental condition and measurement results are presented in Table 10.

TABLE 10

| Category | Steels | Coating metal type | Metal coating thickness (nm) | Enriched metal content within 1 μm of surface layer (wt %) | Zn plating layer thickness (μm) | Alloying temperature (° C.) | Hot press heating temperature (° C.) | Hot press heating time (min) | Plating layer thickness after hot pressing (μm) | Ratio of Fe-rich phase in plating layer | Maximum crack depth of processed part (μm) |
|---|---|---|---|---|---|---|---|---|---|---|---|
| Inventive Example 1 | Steel 1 | Ni | 20 | 1.8 | 8 | — | 910 | 6 | 17 | 95 | — |
| Inventive Example 2 | Steel 2 | Ni | 20 | 1.8 | 8 | 560 | 850 | 6 | 19 | 95 | — |
| Inventive Example 3 | Steel 2 | Ni | 15 | 1.4 | 12 | — | 930 | 7 | 25 | 85 | — |
| Inventive Example 4 | Steel 3 | Ni | 20 | 1.8 | 8 | — | 930 | 5 | 19 | 85 | — |
| Inventive Example 5 | Steel 3 | Ni | 120 | 9.5 | 10 | — | 900 | 5 | 24 | 90 | — |
| Inventive Example 6 | Steel 2 | — | — | — | 8 | — | 910 | 5 | — | 99 | — |
| Inventive Example 7 | Steel 3 | — | — | — | 7 | 560 | 900 | 5 | 0.5 | 99 | — |
| Comparative Example 1 | Steel 2 | Ni | 300 | 21 | 18 | — | 910 | 4 | 27 | 45 | 460 |

First, in Inventive Examples 1 to 7, thicknesses of zinc plating layers were limited to not more than 15 μm such that ratios of Fe-rich phases in the plating layers after hot-pressing processes were controlled to be 70 wt % or more with respect to the total plating layers. Thus, inhibition of cracks in processed parts was possible.

In particular, in Inventive Examples 1 to 5, annealing oxides between base steel sheets and plating layers were controlled to be thin through metal surface diffusion layers and thus, alloying were obtained by allowing Fe of the based irons to sufficiently diffuse into the zinc plating layers. It may be confirmed that heat resistances and corrosion resistances were well secured because Zn in the plating layers did not disappear after hot press heating and the thick plating layers were maintained.

However, since a coating amount of Ni was too large in Comparative Example 1, an amount of enriched metal within 1 μm of a surface layer was also excessive. As a result, alloying was performed too rapidly because annealing oxide was excessively thin and thus, a thickness of a plating layer became 18 μm. Therefore, cracks in a processed part occurred in a maximum depth of 460 μm, because a ratio of a Fe-rich phase in the plating layer after hot pressing was a low value of 45 wt %. It may be analyzed that Zn existed in a liquid phase because an amount of a Zn-rich phase was too large in comparison to that of the Fe-rich phase included in the plating layer, and this may affect crack generation in a base steel sheet.

Figure 5:
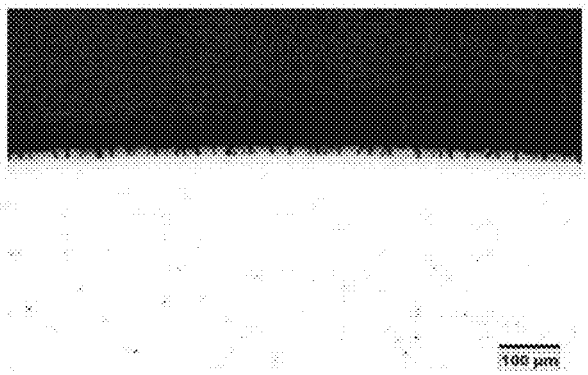
FIG. 5 is a photograph showing a cross section of a processed portion of a hot-pressed part manufactured according to another Comparative Example.
Figure 6:
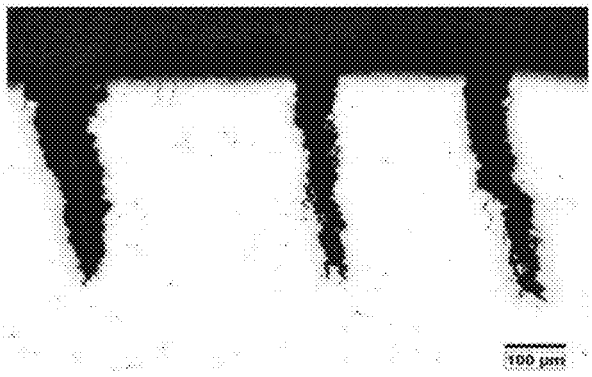
FIG. 6 is a photograph showing a cross section of a processed portion of a hot-pressed part manufactured according to another Inventive Example.

Also, in order to more clearly understand the crack generation in the processed parts according to ratio of a Fe-rich phase in the plating layer, cross sections of hot-pressed parts manufactured according to Comparative Example 1 and Inventive Example 4 are presented in FIGS. 5 and 6, respectively. As a result, cracks were deeply generated along a base steel sheet in the processed part in FIG. 5, in which a Fe-rich phase having a Fe content of 60 wt % or more was not more than 70 wt % with respect to a total plating layer. In contrast, cracks in the processed part almost not occurred in FIG. 6, in which the Fe-rich phase was more than 70 wt %, and thus, it may be confirmed that processability is very good.

EXAMPLE 6

First, experiments were conducted on steel sheets obtained by cold rolling steels having compositions listed in Table 11.

TABLE 11

| Category (wt %) | C | Si | Mn | p | S | Al |
|---|---|---|---|---|---|---|
| Steel 1 | 0.17 | 0.25 | 1.4 | 0.01 | 0.001 | 0.02 |
| Steel 2 | 0.24 | 0.04 | 2.3 | 0.008 | 0.0015 | 0.025 |
| Steel 3 | 0.22 | 1.0 | 1.7 | 0.01 | 0.001 | 0.04 |

Surfaces of the steel sheets before annealing were coated with predetermined metals under conditions listed in the following Table 12 and hot-dip zinc plated steel sheets were then manufactured by annealing at a temperature of 800° C. and dipping in a zinc plating bath containing 0.21 wt % of Al. Thicknesses of metal coating layers, contents of the metals enriched to depths of 1 μm from the surfaces, and thicknesses of Zn plating layers were measured through GOEDS analyses. In order to increase accuracy of data, the data were compared and verified by scanning electron microscope (SEM) and TEM observations on cross sections of the samples, wet analyses, and electron spectroscopy for chemical analysis (ESCA) method.

Thereafter, hot-pressing processes were performed on the hot-dip zinc plated steel sheets, temperatures of the hot press heating furnace were in a range of 750° C. to 950° C., and heating furnace atmospheres were air atmospheres. The hot-pressing processes were completed, and then oxides formed on the surfaces and alloy phases in the plating layers were analyzed through XRD and GOEDS analyses on the surfaces of the plating layers, and the thicknesses of the plating layers and states of the plating layers were measured through analyses on the cross sections of the samples.

For reference, the thicknesses of the plating layers were obtained by measuring lengths in a perpendicular direction from the surfaces to positions at which the contents of Zn in the plating layers were 30 wt % or more after hot pressing. Each experimental condition and measurement results are presented in Table 12.

TABLE 12

| Category | Steels | Coating metal type | Metal coating thickness (nm) | Enriched metal content within 1 μm of surface layer (wt %) | Zn plating layer thickness (μm) | Alloying temperature (° C.) | Hot press heating temperature (° C.) | Hot press heating time (min) | Plating layer thickness after hot pressing (μm) | Enriched metal amount in plating layer after hot pressing (wt %) |
|---|---|---|---|---|---|---|---|---|---|---|
| Inventive Example 1 | Steel 1 | Ni | 50 | 4.3 | 8 | — | 910 | 5 | 17 | 0.21 |
| Inventive Example 2 | Steel 2 | Ni | 50 | 4.5 | 14 | 560 | 900 | 7 | 24 | 0.12 |
| Inventive Example 3 | Steel 2 | Ni | 80 | 7 | 4 | — | 900 | 4 | 10 | 0.41 |
| Inventive Example 4 | Steel 3 | Ni | 20 | 1.8 | 8 | — | 930 | 7 | 19 | 0.08 |
| Inventive Example 5 | Steel 3 | Fe—Ni | 200 | 16 | 10 | — | 900 | 5 | 24 | 0.34 |
| Inventive Example 6 | Steel 2 | Co | 50 | 4.5 | 12 | — | 900 | 6 | 25 | 0.12 |
| Inventive Example 7 | Steel 3 | Ni | 10 | 0.8 | 7 | — | 750 | 7 | 14 | 0.06 |
| Comparative Example 1 | Steel 2 | — | — | — | 12 | — | 900 | 7 | — | — |
| Comparative Example 2 | Steel 3 | — | — | — | 7 | 560 | 910 | 5 | — | — |
| Comparative Example 3 | Steel 3 | — | — | — | 7 | 560 | 770 | 5 | 2 | — |
| Comparative Example 4 | Steel 3 | — | — | — | 10 | 560 | 910 | 5 | — | — |
| Comparative Example 5 | Steel 3 | — | — | — | 10 | — | 910 | 6 | — | — |

Since metals in surface layers were enriched through metal coatings in Inventive Examples 1 to 7, it may be confirmed that plating layers were stably maintained after hot press heating. In particular, since sufficient amounts of enriched metals in the plating layers were included in the plating layers after hot pressing, it may be analyzed that loss of Zn in zinc plating layers were effectively prevented through formation of ternary phases.

In contrast, since metals in surface layers were not enriched because metal coatings were omitted in Comparative Examples 1 to 5, it may be confirmed that plating layers disappeared after hot press heating. In particular, since there were no enriched metals in the plating layers after hot pressing, it may be analyzed that ternary phases, which may prevent loss of Zn into the base steel sheets, were not formed.

Also, the present inventors confirmed relationships between $Al_2O_3$ oxide coating layers formed on the plating layers and the thicknesses or states of the plating layers, and conducted the following experimentations in order to further confirm effects of the oxide coating layers on coatability. Distributions of elements in depth directions were measured by using GOEDS to measure continuities and thicknesses of the $Al_2O_3$ oxide coating layers, and surfaces of samples were processed by using focused ion beam (FIB) to observe the samples by TEM. Thicknesses of oxides at upper layer portions of the $Al_2O_3$ oxide coating layers were measured by using GOEDS. Also, coatabilities were also evaluated by coating the surfaces and the results thereof are presented in Table 13.

TABLE 13

| Category | Continuity of $Al_2O_3$ oxide coating layer | $Al_2O_3$ oxide coating layer thickness (nm) | Thickness of oxide at upper layer portion (μm) | ZnO content in oxide at upper layer portion (wt %) | Electro-deposition coatability |
|---|---|---|---|---|---|
| Inventive Example 1 | Continuous | 60 | 3 | 92 | Good |
| Inventive Example 2 | Continuous | 80 | 4 | 90 | Good |
| Inventive Example 3 | Continuous | 50 | 2 | 92 | Good |
| Inventive Example 4 | Continuous | 100 | 3 | 91 | Good |
| Inventive Example 5 | Continuous | 60 | 2 | 93 | Good |
| Inventive Example 6 | Continuous | 70 | 2 | 89 | Good |
| Inventive Example 7 | Continuous | 40 | 0.5 | 95 | Good |
| Comparative Example 1 | Discontinuous | — | 7 | 20 | Poor |
| Comparative Example 2 | Discontinuous | — | 8 | 15 | Poor |
| Comparative Example 3 | Discontinuous | — | 5 | 40 | Poor |
| Comparative Example 4 | Discontinuous | — | 7 | 25 | Poor |
| Comparative Example 5 | Discontinuous | — | 9 | 22 | Poor |

In Inventive Examples 1 to 7, $Al_2O_3$ oxide coating layers having thicknesses range of 40 nm to 100 nm were continuously formed, thicknesses of oxides at upper layer portions were not more than 5 μm, and contents of ZnO in the oxides were more than 50 wt %. Therefore, deteriorations of Zn in the Zn plating layers were prevented by the foregoing thicknesses and structures of the oxide layers and thus, it may be understood that this may contribute to stably maintain the zinc plating layers as shown in Table 12 above.

Also, it may be understood that coatabilities were also good during electrodeposition coatings because the $Al_2O_3$ oxide coating layers were continuously formed.

In contrast, $Al_2O_3$ oxide coating layers were non-uniformly formed in Comparative Examples 1 to 5 and oxides at upper layer portions having too high thicknesses were formed. As a result, Zn in Zn plating layers easily deteriorated as shown in Table 12 and thus, it may be understood that the Zn plating layers were unstably maintained.

Also, since the $Al_2O_3$ oxide coating layers were non-uniformly formed, it may be understood that coatabilities were poor during electrodeposition coatings.

Next, the present inventors conducted experimentations in which phosphate treatments were performed and not performed on samples of Inventive Examples 1 and 2. Electrodeposition coating treatments were performed and electrodeposited coating layers were then cut in a "X" shape across diagonals of the samples. Thereafter, ten-cycle cyclic corrosion tests (CCTs) were conducted, and average and maximum delamination widths of the plating layers around the X-shaped cuts were then measured. Since coatabilities of Comparative Examples 1 and 2 were poor, coating treatments were performed after conducting phosphate treatments. Then, the foregoing experimentations were performed on Comparative Examples 1 and 2, and the results thereof are presented in Table 14.

TABLE 14

| Category | Presence of phosphate treatment | Phosphate coating weight ($g/m^3$) | Average delamination width after CCT (μm) | maximum delamination width after CCT (μm) |
|---|---|---|---|---|
| Comparative Example 1 | Presence | 2.1 | 1.3 | 4 |
| Comparative Example 2 | Presence | 3.5 | 1.9 | 5 |
| Inventive Example 1 | Presence | 9.1 | 0.2 | 0.5 |

TABLE 14-continued

| Category | Presence of phosphate treatment | Phosphate coating weight ($g/m^3$) | Average delamination width after CCT (μm) | maximum delamination width after CCT (μm) |
|---|---|---|---|---|
| Inventive Example 1 | Absence | — | 0.23 | 0.55 |
| Inventive Example 2 | Presence | 10.4 | 0.8 | 2.5 |
| Inventive Example 2 | Absence | — | 0.85 | 2.6 |

With respect to phosphate coating weights, Inventive Examples 1 and 2 had significantly higher values than those of Comparative Examples 1 and 2. Therefore, it may be understood that adhesions of phosphate coatings were also improved as the $Al_2O_3$ oxide coating layers were continuously formed.

Also, with respect to delamination widths after CCT, since Inventive Examples 1 and 2 had significantly lower values than those of Comparative Examples 1 and 2, it may be understood that coating layer adhesions were also much improved as the $Al_2O_3$ oxide coating layers were continuously formed. In particular, with respect to Inventive Examples 1 and 2, it may be confirmed that coating layer adhesions were very good because almost similar delamination widths were obtained even without phosphate treatments due to the continuities of the $Al_2O_3$ oxide coating layers. Therefore, with respect to Inventive Examples 1 and 2, coatabilities and coating layer adhesions were excellent regardless of the presence of phosphate treatments.

FIGS. 8(*a*)-8(*f*) are photographs showing cross sections of a hot-dip Zn plated steel sheet manufactured according to Inventive Example 3. When Al and Ni distribution photographs among these photographs were examined, it may be confirmed that Ni was formed just under a surface of a base steel sheet and an Al-rich layer existed just above Ni. That is, a configuration was obtained, in which a portion enriched with Ni was a metal surface diffusion layer and the Al-rich layer existed thereon. Ni diffused into a plating layer during hot press heating to form a ternary phase together with Zn—Fe, and thus, diffusion of Zn in the Zn plating layer into the base steel sheet was prevented and Al diffused above the plating layer to form an $Al_2O_3$ oxide coating layer.

Figure 9:
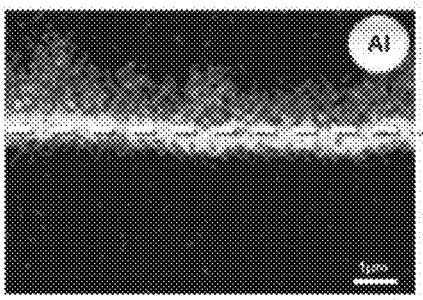
FIGS. 9(*a*) and (*b*) are enlarged aluminum (Al) and nickel (Ni) photographs among the EPMA mapping analysis photographs.
Figure 9:
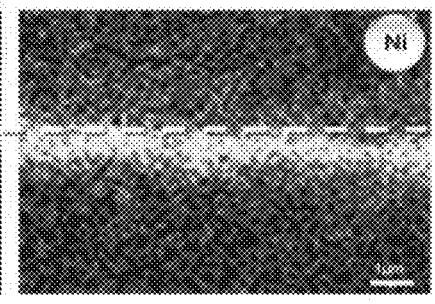

FIGS. 9(*a*) and 9(*b*) are enlarged Al and Ni distribution photographs, in which Al was enriched just above Ni based on a dotted line and portions marked in a red color in the photographs had a large enriched amount of Al or Ni. The portions in the Ni photograph corresponded to regions containing 5 wt % or more of Ni and the portions in the Al photograph corresponded to regions containing 30 wt % or more of Al. That is, with respect to the red portions in the Al photograph and the red portions in the Ni photograph, it may be confirmed that an area, in which both portions were overlapped, was 10% or less.

While the present invention has been shown and described in connection with the exemplary embodiments, it will be apparent to those skilled in the art that modifications and variations can be made without departing from the spirit and scope of the invention as defined by the appended claims.

The invention claimed is:

1. A hot-pressed part comprising:

a base steel sheet;

a zinc plating layer including a Fe—Zn phase having a metal, in which a reduced amount of Gibbs free energy for one mole of oxygen during an oxidation reaction is smaller than that of Cr, dissolved in an amount of about 0.008 wt % or more formed on the base steel sheet; and an oxide layer having an average thickness range of about 0.01 μm to about 5 μm formed on the zinc plating layer, wherein the oxide layer comprises a continuous coating layer having an average thickness range of about 10 nm to about 300 nm, the continuous coating layer comprising one or more oxides selected from the group consisting of $SiO_2$ and $Al_2O_3$, and an oxide including ZnO and MnO is formed on the continuous coating layer.

2. The hot-pressed part of claim 1, wherein the oxide layer comprises ZnO and comprises about 0.01 wt % to about 50 wt % of one or more oxides selected from the group consisting of MnO, $SiO_2$, and $Al_2O_3$.

3. The hot-pressed part of claim 2, wherein a content of MnO in the oxide is smaller than that of ZnO in the oxide.

4. The hot-pressed part of claim 1, wherein the oxide layer comprises about 10 wt % or less of FeO.

5. The hot-pressed part of claim 1, wherein a zinc diffusion phase non-uniformly exists at an upper portion of the base steel sheet.

6. The hot-pressed part of claim 5, wherein an average thickness of the zinc diffusion phase is about 5 μm or less.

7. The hot-pressed part of claim 1, wherein a Zn content of the zinc plating layer is about 30 wt % or more.

8. The hot-pressed part of claim 7, wherein a thickness of the zinc plating layer is about 1.5 times larger than that before hot press forming.

9. The hot-pressed part of claim 1, wherein a ratio of an alloy phase having a Fe content of about 60 wt % or more in the zinc plating layer is about 70 wt % or more with respect to the total zinc plating layer.

10. The hot-pressed part of claim 1, wherein the metal, in which a reduced amount of Gibbs free energy for one mole of oxygen during an oxidation reaction is smaller than that of Cr, is one or more selected from the group consisting of Ni, Fe, Co, Cu, Sn, and Sb.

11. The hot-pressed part of claim 6, wherein the base steel sheet comprises about 0.1 wt % to about 0.4 wt % of C, about 2.0 wt % or less (excluding 0 wt %) of Si, about 0.1 wt % to about 4.0 wt % of Mn, and Fe as well as unavoidable impurities as a remainder.

12. The hot-pressed part of claim 1, wherein the base steel sheet further comprises one or more selected from the group consisting of about 0.001% to about 0.02% of N, about 0.0001% to about 0.01% of B, about 0.001% to about 0.1% of Ti, about 0.001% to about 0.1% of Nb, about 0.001% to about 0.1% of V, about 0.001% to about 1.0% of Cr, about 0.001% to about 1.0% of Mo, about 0.001% to about 0.1% of Sb, and about 0.001% to about 0.3% of W.

* * * * *